US009152081B2

(12) United States Patent
Yasui et al.

(10) Patent No.: US 9,152,081 B2
(45) Date of Patent: Oct. 6, 2015

(54) DEVELOPER ACCOMMODATING CONTAINER, PROCESS CARTRIDGE, ELECTROPHOTOGRAPHIC IMAGE FORMING APPARATUS

(71) Applicant: CANON KABUSHIKI KAISHA, Tokyo (JP)

(72) Inventors: Kojiro Yasui, Numazu (JP); Hiroomi Matsuzaki, Mishima (JP); Koji Yamaguchi, Numazu (JP); Masaaki Matsushita, Yokohama (JP); Tatsuo Fujisaki, Yokohama (JP); Masaki Furutani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/027,415

(22) Filed: Sep. 16, 2013

(65) Prior Publication Data

US 2014/0016961 A1 Jan. 16, 2014

Related U.S. Application Data

(63) Continuation of application No. PCT/JP2012/068531, filed on Jul. 13, 2012.

(30) Foreign Application Priority Data

Jul. 14, 2011 (JP) ..... 2011-155832
Nov. 29, 2011 (JP) ..... 2011-260030

(51) Int. Cl.
*G03G 15/08* (2006.01)
*G03G 21/18* (2006.01)

(52) U.S. Cl.
CPC ..... *G03G 15/0865* (2013.01); *G03G 15/08* (2013.01); *G03G 15/0874* (2013.01); *G03G 15/0882* (2013.01); *G03G 21/18* (2013.01)

(58) Field of Classification Search
USPC ..... 399/98, 102, 103–106, 110, 111, 119, 399/120, 252, 258, 260, 262
See application file for complete search history.

(56) References Cited

U.S. PATENT DOCUMENTS 4,895,104 A * 1/1990 Yoshino et al. ..... 399/106
5,030,997 A * 7/1991 Michlin et al. ..... 399/106

(Continued)

FOREIGN PATENT DOCUMENTS

EP 0 581 199 A2 2/1994
JP H01-161274 A 6/1989

(Continued)

OTHER PUBLICATIONS

English translation of Written Opinion and International Search Report for International Application No. PCT/JP2012/068531.

(Continued)

*Primary Examiner* — Hoan Tran
(74) *Attorney, Agent, or Firm* — Fitzpatrick, Cella, Harper & Scinto

(57) ABSTRACT

A developer accommodating container for accommodating a developer includes a developer bag 16 provided with an injection port for permitting entrance of the developer and an opening 35*a* for permitting discharge of the developer and includes a sealing member 19 which includes a bonded portion bonded to the developer bag 16 so as to seal the opening and which is capable of exposing the opening by peeling the bonded portion from the developer bag 16 by being moved, and the sealing member includes a first bonded portion 22*a* in an upstream side of the opening and a second bonded portion 22*b* in a downstream side of the opening with respect to a sealing member unsealing direction, the first bonded portion and the second bonded portion interposing the opening, and the second bonded portion is provided in a non-contact position with the opening.

38 Claims, 21 Drawing Sheets

(56) References Cited

U.S. PATENT DOCUMENTS

| | | | | |
|---|---|---|---|---|
| 5,594,535 | A * | 1/1997 | Beaufort et al. | 399/262 |
| 5,832,343 | A * | 11/1998 | Kobayashi et al. | 399/119 |
| 5,943,529 | A | 8/1999 | Miyabe et al. | |
| 5,966,567 | A | 10/1999 | Matsuzaki et al. | |
| 6,009,289 | A | 12/1999 | Sekine et al. | |
| 6,011,941 | A | 1/2000 | Takashima et al. | |
| 6,097,906 | A | 8/2000 | Matsuzaki et al. | |
| 6,144,815 | A | 11/2000 | Chadani et al. | |
| 6,173,140 | B1 | 1/2001 | Suzuki et al. | |
| 6,173,145 | B1 | 1/2001 | Chadani et al. | |
| 6,205,305 | B1 | 3/2001 | Suzuki et al. | |
| 6,219,504 | B1 | 4/2001 | Matsuzaki et al. | |
| 6,282,389 | B1 | 8/2001 | Matsuzaki et al. | |
| 6,405,004 | B2 | 6/2002 | Matsuzaki et al. | |
| 6,549,736 | B2 | 4/2003 | Miyabe et al. | |
| 6,681,088 | B2 | 1/2004 | Kanno et al. | |
| 6,782,219 | B2 | 8/2004 | Yoshino et al. | |
| 6,792,229 | B2 | 9/2004 | Matsuzaki | |
| 6,795,666 | B2 | 9/2004 | Miyabe et al. | |
| 6,834,173 | B2 | 12/2004 | Yamaguchi et al. | |
| 6,859,629 | B2 | 2/2005 | Miura et al. | |
| 6,915,092 | B2 | 7/2005 | Yamaguchi et al. | |
| 6,931,226 | B2 | 8/2005 | Chadani et al. | |
| 6,934,485 | B2 | 8/2005 | Miyabe et al. | |
| 6,947,687 | B2 | 9/2005 | Yamaguchi et al. | |
| 6,961,528 | B2 | 11/2005 | Yamaguchi et al. | |
| 6,978,100 | B2 | 12/2005 | Yasui et al. | |
| 6,983,115 | B2 | 1/2006 | Isobe et al. | |
| 7,016,626 | B2 | 3/2006 | Yokomori et al. | |
| 7,068,965 | B2 | 6/2006 | Yoshino et al. | |
| 7,085,516 | B2 | 8/2006 | Kawai et al. | |
| 7,116,925 | B2 | 10/2006 | Yamaguchi | |
| 7,136,604 | B2 | 11/2006 | Chadani et al. | |
| 7,155,137 | B2 | 12/2006 | Yasui et al. | |
| 7,184,687 | B2 | 2/2007 | Yamaguchi et al. | |
| 7,194,225 | B2 | 3/2007 | Yamaguchi | |
| 7,224,925 | B2 | 5/2007 | Sato et al. | |
| 7,319,834 | B2 | 1/2008 | Yamaguchi | |
| 7,349,657 | B2 | 3/2008 | Sato et al. | |
| 7,412,193 | B2 | 8/2008 | Sato et al. | |
| 7,477,865 | B2 | 1/2009 | Yamaguchi | |
| 7,519,310 | B2 | 4/2009 | Yamaguchi et al. | |
| 7,792,460 | B2 | 9/2010 | Yamaguchi et al. | |
| 8,121,519 | B2 | 2/2012 | Yamaguchi et al. | |
| 8,577,252 | B2 | 11/2013 | Anan et al. | |
| 2011/0020031 | A1 | 1/2011 | Sato et al. | |
| 2011/0170906 | A1 | 7/2011 | Matsushita et al. | |
| 2012/0027457 | A1 | 2/2012 | Yamaguchi et al. | |
| 2013/0136489 | A1 | 5/2013 | Yamaguchi et al. | |
| 2013/0164039 | A1 | 6/2013 | Matsushita et al. | |
| 2013/0164040 | A1 | 6/2013 | Matsushita et al. | |
| 2013/0336679 | A1 | 12/2013 | Furutani et al. | |
| 2013/0343785 | A1 | 12/2013 | Matsuzaki et al. | |
| 2014/0029974 | A1 | 1/2014 | Uesugi et al. | |
| 2014/0064793 | A1 | 3/2014 | Matsuzaki et al. | |
| 2014/0072329 | A1 | 3/2014 | Uesugi et al. | |
| 2014/0072330 | A1 | 3/2014 | Yoshida et al. | |
| 2014/0072331 | A1 | 3/2014 | Matsushita et al. | |
| 2014/0072346 | A1 | 3/2014 | Furutani et al. | |
| 2014/0072347 | A1 | 3/2014 | Furutani et al. | |
| 2014/0079432 | A1 | 3/2014 | Matsuzaki et al. | |
| 2014/0126928 | A1 | 5/2014 | Batori et al. | |

FOREIGN PATENT DOCUMENTS

| | | |
|---|---|---|
| JP | 4-66980 | 3/1992 |
| JP | 9-106156 | 4/1997 |
| JP | 9-114216 | 5/1997 |
| JP | 10-143505 | 5/1998 |
| JP | 2916332 B2 | 7/1999 |
| JP | 2003-241494 | 8/2003 |
| JP | 2003-263104 | 9/2003 |

OTHER PUBLICATIONS

Extended Search Report in European Patent Application No. 12811163.0, dated Dec. 2, 2014.

English translation of Written Opinion and International Search Report for International Application No. PCT/JP2012/068531, Jul. 13, 2012.

* cited by examiner

DEVELOPER ACCOMMODATING CONTAINER, PROCESS CARTRIDGE, ELECTROPHOTOGRAPHIC IMAGE FORMING APPARATUS

TECHNICAL FIELD

The present invention relates to a developer accommodating container, and a process cartridge and an image forming apparatus which use this (developer accommodating container).

Here, the image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the process cartridge refers to a cartridge into which a photosensitive member and a process means such as a developing means actable on this photosensitive member are integrally assembled and which cartridge is made detachably mountable to an image forming apparatus main assembly.

Further, a developer accommodating unit is at least a provided with a flexible container for accommodating the developer.

BACKGROUND ART

In a conventional electrophotographic image forming apparatus using the electrophotographic image forming process, a process cartridge type in which an electrophotographic photosensitive member and process means actable on the photosensitive member are integrally assembled into a cartridge and this cartridge is detachably mountable to a main assembly of the electrophotographic image forming apparatus is employed.

In such a process cartridge, as shown in FIG. 25, an opening provided to a developer accommodating container 100 for accommodating the developer (toner, carrier, etc.) is sealed with a sealing member 101 constituted by a seal member or the like. Further, a type in which a bonded portion 102 of the sealing member 101 is pulled and peeled during use, thus unsealing the opening to enable supply of the developer has been widely employed (Japanese Laid-Open Patent Application (JP-A) Hei 4-66980).

Further, against a problem such that the developer is scattered in the process cartridge in a developer filling step during manufacturing of the process cartridge, a constitution in which the developer accommodating container 100 is made deformable has been devised (JP-A Hei 4-66980).

DISCLOSURE OF THE INVENTION

In the developer accommodating container including a toner bag as in JR-A Hei 4-66980, the toner bag is provided with the opening for permitting discharge of the developer, and the sealing member is bonded to this opening to close the opening, and then the sealing member is removed during use to enable supply of the developer.

However, in the case of the deformable developer accommodating container, also the opening of the developer accommodating container is deformable and therefore when the developer accommodating container is unsealed by pulling the sealing member which seals the opening, the opening is palled together with the sealing member, so that there is a possibility that the opening is largely deformed. Further, when the opening is deformed when the sealing member is pulled, unsealing is not stable.

An object of the present invention is to improve an unsealing characteristic when the flexible container for accommodating the developer is unsealed.

A representative constitution according to the present invention is a developer accommodating container for accommodating a developer, comprising: a flexible container provided with an opening for permitting discharge of the developer; and a sealing member which includes a bonded portion bonded to the flexible container so as to seal the opening and which is capable of exposing the opening by peeling the bonded portion from the flexible container by being moved, wherein the sealing member includes a first bonded portion in an upstream side of the opening and a second bonded portion in a downstream side of the opening with respect to a sealing member unsealing direction, the first bonded portion and the second bonded portion interposing the opening, and the second bonded portion is provided in a non-contact position with the opening.

According to the present invention, when the opening of the flexible container is unsealed by moving the sealing member, a force exerted on the opening is weakened, so that deformation of the opening can be suppressed and it becomes possible to effect stable unsealing.

BEST MODE FOR CARRYING OUT THE INVENTION

Figure 1:
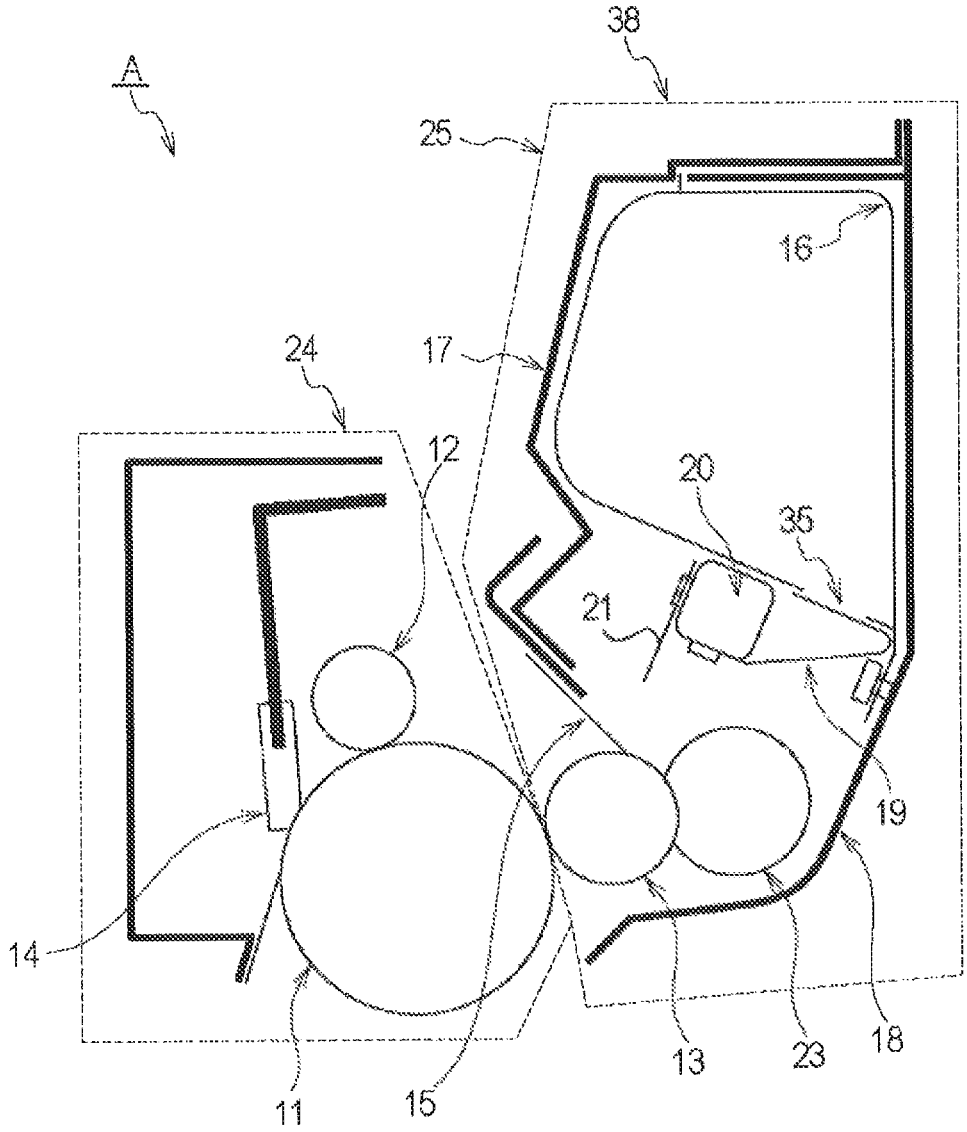
FIG. 1 is a principal sectional view of a process cartridge.

To the following description, a developer accommodating container refers to at least a flexibility container and a sealing member for sealing an opening, provided to the flexible container, for permitting discharge of a developer. The developer accommodating container before the developer is accommodated therein is referred to as a developer accommodating container 37 for accommodating the developer. The developer accommodating container which accommodates the developer and which is provided with an unsealing member for unsealing the sealing member is referred to as a developer accommodating container 30 including the unsealing member. The developer accommodating container which accommodates the developer and which is not provided with the sealing member is referred to as a developer accommodating container 26 accommodating the developer.

Incidentally, for simplification, these developer accommodating containers will be described as the developer accommodating container 37, the developer accommodating container 30 and the developer accommodating container 26 by using different reference numerals.

A developer accommodating unit includes at least the developer accommodating container and a frame for accommodating the developer accommodating container.

(First Embodiment)

Figure 2:
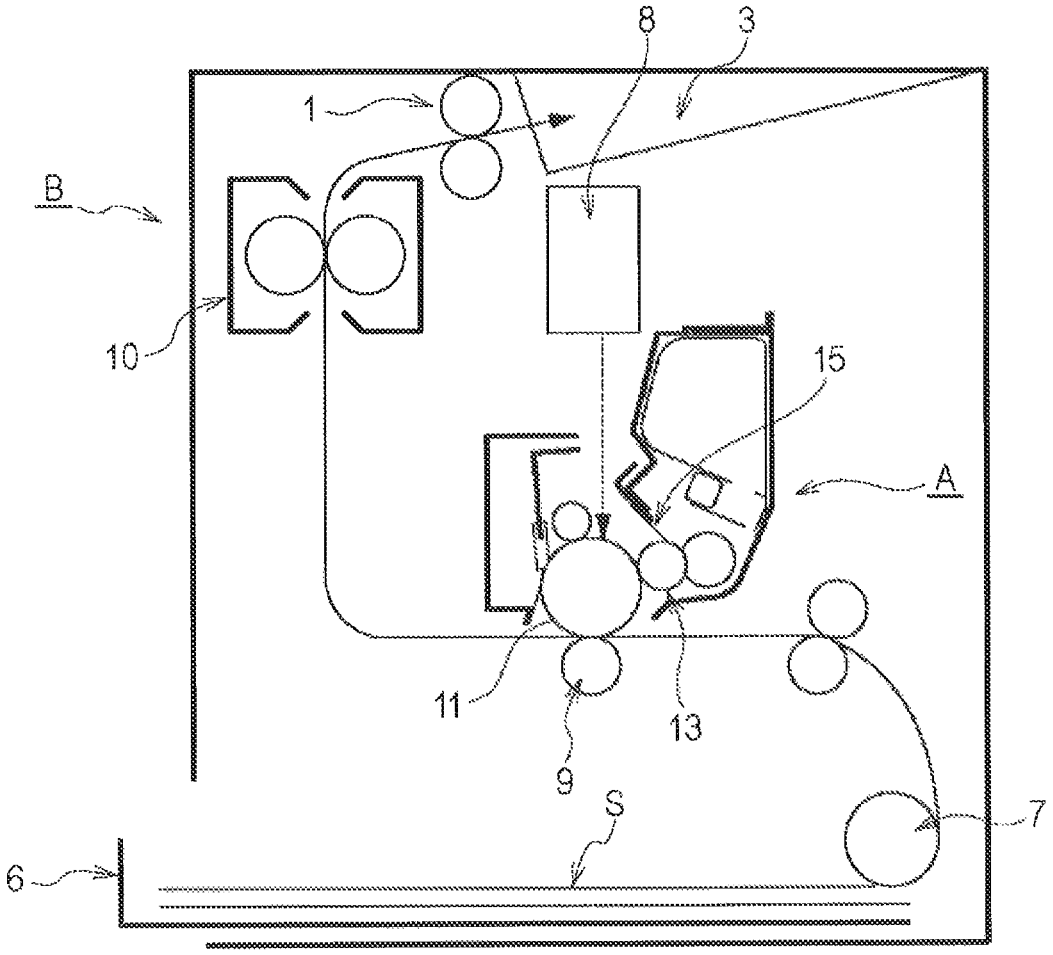
FIG. 2 is a principal sectional view of an image forming apparatus.

FIG. 1 illustrates a principal sectional view of a process cartridge including the developer accommodating unit to which the present invention is applicable, and FIG. 2 illustrates a principal sectional view of an electrophotographic image forming apparatus to which the present invention is applicable.

<Summary of Structure of Process Cartridge>

The process cartridge includes an image bearing member as an electrophotographic photosensitive member and process means actable on the image bearing member, and is detachably mountable to the image forming apparatus. Here, as the process means, there are, e.g., a charging means for electrically charging a surface of the image bearing member, a developing device for forming an image on the image bearing member, and a cleaning means for removing a developer (containing toner, carrier, etc.) remaining on the image bearing member surface.

The process cartridge A in this embodiment includes, as shown in FIG. 1, includes a photosensitive (member) drum 11 as the image bearing member and includes, at a periphery of the photosensitive drum 11, a charging roller 12 as the charging means and a cleaner unit 24 including a cleaning blade 14, having elasticity, as the cleaning means. Further, the process cartridge A includes a developer accommodating unit 25 including a first frame 17 and a second frame 18. The process cartridge A integrally includes the cleaner unit 24 and the developer accommodating unit 25, and is constituted so as so be detachably mountable to an image forming apparatus main assembly B as shown in FIG. 2. A developing device 38 includes a developing roller 13 as the developing means, a developing blade 15, a developer supplying roller 23, and a developer accommodating container 26, for accommodating the developer, in which the developer is accommodated. The developing roller 13 and the developing blade are supported by the first frame 17.

<Summary of Structure of Image Forming Apparatus>

The process cartridge A is mounted in the image forming apparatus main assembly B as shown in FIG. 2 and is used for image formation. In the image formation, a sheet S is fed by a feeding roller 7 from a sheet cassette 6 mounted at a lower portion of the apparatus, and in synchronism with this sheet feeding, the photosensitive drum 11 is selectively exposed to light by an exposure device 3 to form a latent image. The developer is supplied to the developing roller 13 (developer carrying member) by the sponge-like developer supplying roller 23 and is carried in a thin layer on the surface of the developing roller 13. By applying a developing bias to the developing roller 13, the developer is supplied depending on the latent image and thus the latent image is developed into a developer image. This (developer) image is transferred onto the fed sheet 3 by bias voltage application to a transfer roller 9. The sheet S is conveyed to a fixing device 10 to be subjected to image fixing, and the sheet S is discharged by a discharging roller 1 to a discharge portion 3 at an upper portion of the apparatus.

<Developer Accommodating Unit>

Figure 3:
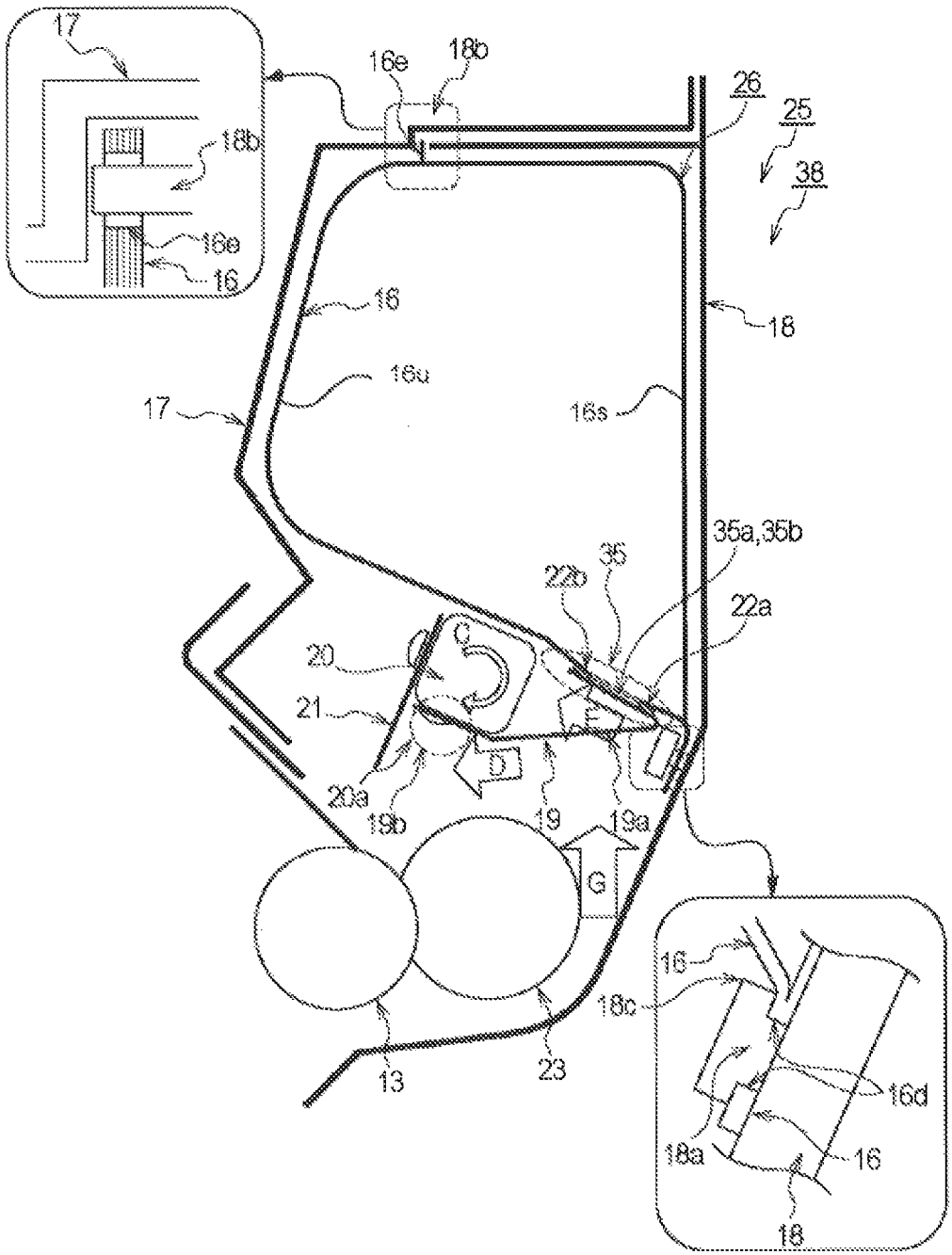
FIG. 3 is a sectional view of a developer accommodating unit before unsealing.

The developer accommodating unit 25 is, as shown in FIG. 3, constituted from the developer accommodating container 30, the developing roller 13, the developing blade 15, the developer supplying roller 23, and the first frame 17 and the second frame 18 which support these members. A combination of the first frame 17 and the second frame 16 is a frame which accommodates the developer accommodating container 30.

Incidentally, in this embodiment, the developer accommodating unit 25 is the same as the developing device 38. This is because the developer accommodating unit 25 includes the developing roller 13 and the developing blade 15. However, the developing roller 13 and the developing blade 15 may also be supported by a frame separately from the developer accommodating unit 25 and thus may be separated from the developer accommodating unit 25. In this case, the developing device 38 is constituted by the developer accommodating unit 25, the developing roller 13 and the developing blade 15 (not shown in FIG. 3).

<Developer Accommodating Container>

Figure 4:
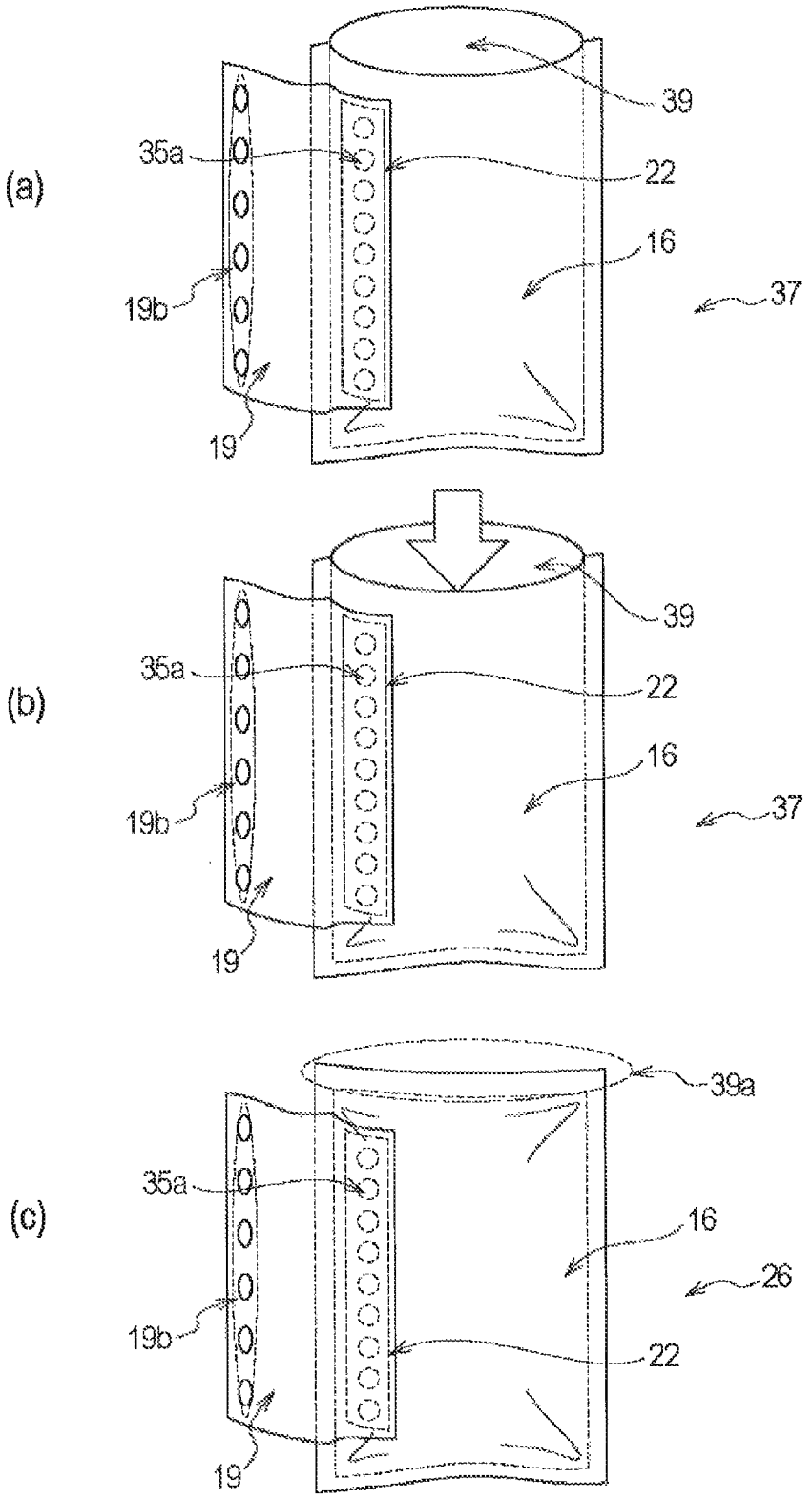
FIG. 4 includes illustrations of a developer accommodating container.
Figure 5:
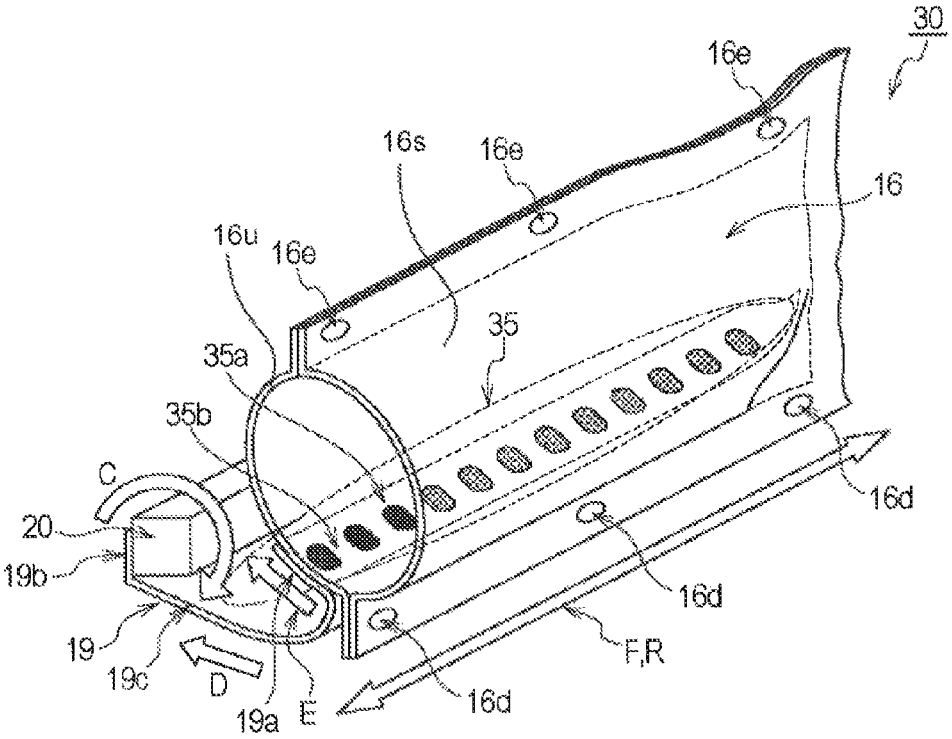
FIG. 5 is a perspective view from a cross section or the developer accommodating container including an unsealing member.

Next, a constitution of the developer accommodating container 26 will be described with reference to FIG. 4 and FIG. 5. FIG. 4 is includes perspective views of the developer accommodating container, and FIG. 5 is a perspective view from a cross section of the developer accommodating container 26 in a state in which the unsealing member 20 it mounted to the developer accommodating container 26. Incidentally, the cross section (sectional view) is a flat plane passing through the unsealing member 20, the openings 35*a* and the portions-to-be-fixed 16*d*. Further, the cross section is a flat plane perpendicular to a rotation shaft (axis) of the unsealing member 20.

As shown in (a) of FIG. 4, the developer accommodating container 37 for accommodating the developer which is powder is constituted from the developer bag 16 which is the flexible container and the sealing member 19 for sealing the plurality of openings 35*a* for permitting the discharge of the developer and for exposing the openings 35*a* . by being moved. Here, the developer bag 16 of the developer accommodating container 37 for accommodating the developer includes the filling opening 39 for permitting the filling of the developer and the openings 35*a* for permitting the discharge of the developer.

Here, in the developer accommodating container 37 for accommodating the developer, the developer is not filled as yet, and the developer accommodating container 37 is in a state in which a filling (injection) opening 35 for permitting the filling of the developer is open.

As shown in (b) of FIG. 4, the developer is filled from the filling opening 39 of the above-described developer accommodating container 37. At this time, by flexibility of the developer bag 16, the filling opening 39 for permitting the filling of the developer is deformable correspondingly to a filling device and thus the filling of the developer is facilitated without causing scattering of the developer. At the time of the filling, a known auger type filling device is used but another method having a similar function may also be used.

Then, as shown in (c) of FIG. 4, the filling opening 39 for permitting the filling of the developer is bonded and sealed. The bonding of the bonded portion 39*a* of the opening for permitting the filling of the developer is made by ultrasonic welding in this embodiment but may also be made by other bonding methods using heat, a laser and the like.

Then, when the bonding of the bonded portion 39*a* of the opening for permitting the filling is completed, the developer is filled, so that the developer accommodating container 26 in which the developer is accommodated is provided.

Incidentally, a position and a size of the filling opening 39 for permitting the filling may appropriately by disposed correspondingly to shapes and the like of the filling device of the developer and the process cartridge A.

Thus, each of the openings 35*a* and the filling opening 39 of the developer accommodating container 26 in which the developer is accommodated is sealed and therefore the developer accommodating container 26 can be treated as a single unit without causing leakage of the accommodated developer to the outside. Further, the sealing member 19 is provided with a hole which is a portion-to-be-engaged 39*b* to be engaged with the unsealing member 20, and is engageable with the unsealing member 20 (see FIG. 5).

By terming the developer-accommodated developer accommodating container 26 in a bag shape, the developer can be treated as a unit. For that reason, a developer filling step can be separated from a main assembling step (manufacturing line) of the process cartridge A. By this, the developer is prevented from being scattered in the main assembling step (manufacturing line) of the process cartridge A, so that maintenance such as cleaning of the manufacturing line can be reduced. By the prevention of the scattering of the developer during the assembling step, it is possible to omit a cleaning stop of the process cartridge A so be performed after the filling of the developer.

Further, also in the filling step of the developer bag 16, the developer bag 16 has flexibility, and the filling opening 39 for permitting the filling is also soft and therefore can be easily sealed with less scattering.

Further, the developer accommodating container 26 in which the developer is accommodated has flexibility and therefore can be assembled while following a shape of the frame.

Further, in the filling step, the developer accommodating container 37 has flexibility and therefore deforms its cross section to increase its volume in which the developer can be filled, so that a filling amount can be increased during the filling.

Further, the developer accommodating container 37 before the developer filling has flexibility and thus can be made small (thin), so that a storing space during storage before the filling can be made small compared with the frame which is a resinous structure.

<Developer Bag>

As shown in FIG. 3 and FIG. 5, the developer bag is accommodates the developer therein and has a bag-like shape which is deformable, and is provided with the plurality of openings 35*a* at the discharging portion 35, for permitting the discharge of the accommodated developer.

Further, the developer bag 16 includes developer bag fixing portions (portions-to-be-fixed) 16*d* and 16*e* fixed to the first frame 17 and the second frame 18.

(Air Permeability of Developer Bag)

As shown in FIG. 5, the developer bag 16 is constituted by bonding a sheet 16*u* which includes the discharging portion 35 and does not have air permeability (hereinafter, "non-air permeable sheet") and a sheet 16*s* which has the air permeability and which is an air permeable portion (hereinafter, "air permeable sheet") to each other.

Here, a degree of the air permeability of the air permeable sheet 16*s* may appropriately be selected so that the developer is prevented from leaking out of the developer bag 16 based oh a balance with a size of the developer (particle size of powder) to be accommodated.

As a material for the air permeable sheet 16*s*, a nonwoven fabric or the like formed of polyethylene terephthalate (PET), polyethylene (PE), polypropylene (PP) or the like in a thickness of 0.03-0.15 mm is preferred. Further, even when the material for the air permeable portion 16*s* is not the nonwoven fabric, a material having minute holes which are smaller than the powder such as the developer may also be used.

Further, with respect to arrangement of the air permeable portion, in this embodiment, as shown in FIG. 3 and FIG. 29, the air permeable sheet 16*s* is disposed, over the entire region of the developer bag 16 with respect to a longitudinal direction in the second frame 18 side. Incidentally, the air permeable sheet 16*s* may also constitute the entire developer bag 16.

Incidentally, as the material for the developer bag 16 other than the air permeable sheet 16*s*, a material having flexibility so as to improve efficiency during the discharge of the developer described later may preferably be used. Further, the material for the air permeable sheet 16*s* may also have flexibility.

Thus, the reason why the air permeability is imparted to the developer bag 16 is that the developer bag 16 can meet states during manufacturing, during transportation until a user uses the cartridge A, and during storage. First, the reason for the state during the manufacturing is that the developer bag 16 is made deformable and reducible in order to facilitate assembling of the developer bag 16 with the frames 17 and 18. In the case where the developer bag 16 is not provided with the air permeability portion, the size thereof cannot be changed from that in a state in which the developer bag 16 is filled with the developer (state in which the bag is closed) and therefore the developer bag 16 is not readily deformed. For that reason, it takes time to assembling and steps are complicated. Therefore, when the air permeability is imparted to at least a part of the developer bag 16, the size of the developer bag 16 can be changed from that in the state in which the developer bag 16 is filled with the developer and then is closed, thus facilitating the assembling.

Next, the reason for the states during the transportation and during the storage is that the developer bag 16 can meet a change in different air pressure during the transportation and during the storage of the process cartridge A. The difference in air pressure between the inside and outside of the developer bag 16 is generated in the case where the developer bag 16 is in a lower air-pressure environment during the transportation or the like than during the manufacturing or in the case where the developer bag 16 is stored at a higher temperature than during the manufacturing. For that reason, by expansion of the developer bag 16, there is a fear that parts contacting the developer bag 16 are deformed or broken. There is a need, for that purpose, to control the air pressure and the temperature during the transportation and during the storage, so that facilitates and a cost are needed. However, problems caused due to the difference in air pressure between the inside and outside of the developer bag 16 can be solved by partly imparting the air permeability to the developer bag 16.

Further, in the case where the nonwoven fabric is provided with the discharging portion 35 and a bonded portion 22 at a periphery of the discharging portion 35, there is a fear that fibers of the nonwoven fabric fall out with peeling of the sealing member 19 during unsealing and then enter the developer to adversely affect the image. For that reason, by providing the discharging portion 35 to the non-air permeable sheet 16*u*, the above-described falling-out of the fibers from the nonwoven fabric is prevented.

Further, a filling density can be increased by filling the developer while effecting deaeration from the air permeable sheet 16*s*.

(Structure of Discharging Portion of Developer Bag)

Figure 6:
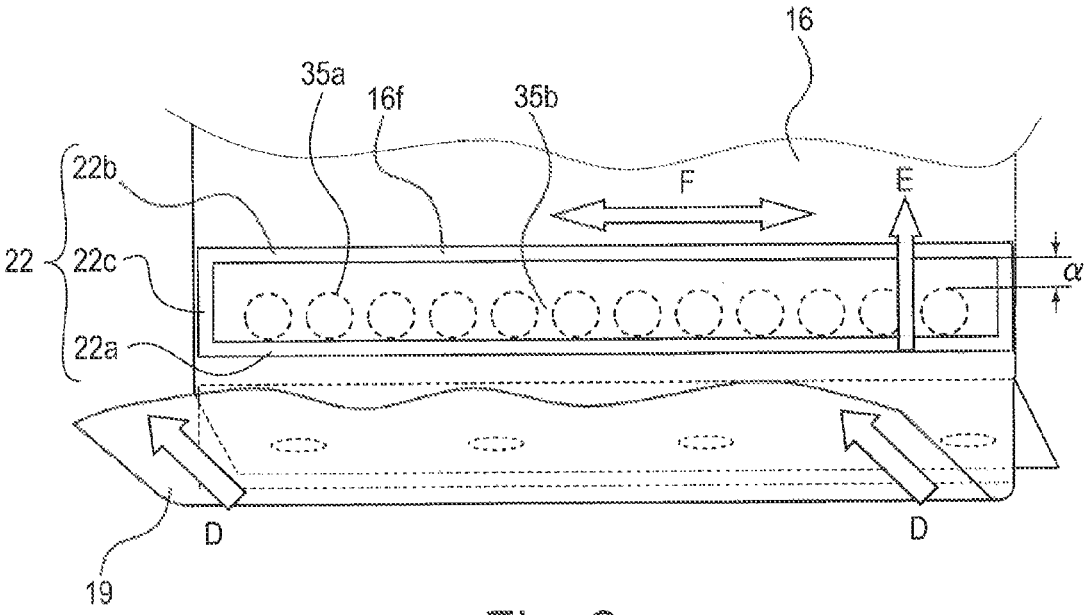
FIG. 6 is an illustration of the developer accommodating container before unsealing.

As shown in FIG. 5 and FIG. 6, the developer bag 16 includes the developer discharging portion 35 consisting of the plurality of openings 35*a* for permitting the discharge of the inside developer and the connecting portion 35*b* defining the plurality of openings 35*a*. Further, as described later, the discharging portion 35 is continuously surrounded at its periphery by the bonded portion 22 to be unsealably bonded, so that the developer accommodated in the developer bag 16 is sealed with the sealing member 19. Further, the sealing member 19 is wound up by the unsealing member 20, thus being made unscalable.

(Arrangement of Openings of Developer Bag)

Next, arrangement of the openings 35*a* will be described with reference to FIG. 6 and FIG. 7. The openings 35*a* are sealed by the sealing member 19, and by movement of the sealing member 19, the openings 35*a* are exposed and unsealed. The movement direction of the sealing member 19 (the direction of the sealing member 19 pulled by the unsealing member 20) at this time is an arrow D direction. By the movement of the sealing member 19, the exposure of the openings 33*a* progresses in the unsealing direction (arrow E direction). In the following, the movement direction of the sealing member 19 is D.

The openings 35*a* in this embodiment are provided at a plurality of positions where circular holes are provided to the developer bag 16 at predetermined intervals, and the respective openings 35*a* are connected therebetween by the connecting portions 35*b*. The plurality of the openings 35*a* and the connecting portions 35*b* are disposed to be arranged in the direction F perpendicular to the unsealing direction E.

Here, the reason why the rotational axis direction of the developing roller 13 and the arranged direction F of the plurality of openings 35*a* are made equal is that the developer is easily supplied, during the discharge thereof, to the developing roller 13 over the entire longitudinal direction without being localized.

As described above, the plurality of openings 35*b* are disposed at the different positions in the arrow F direction and therefore the discharging portion 35 is long in the direction F and is short in the direction E perpendicular thereto. That is, with respect to the direction F, a distance from an end to another end of the plurality of openings 35*a* is longer than that with respect to the arrow E direction.

Further, the sealing member 19 is configured to be wound up by rotating the unsealing member 20, but the above-described direction F is the same direction as an axis (axial line) of the rotation shaft of the unsealing member 20. Thus, the discharging portion 35 where the plurality or openings 35*a* are disposed at the different positions in the direction F perpendicular to the unsealing direction F is long in the direction F and is short in the direction E, and therefore the distance required for the unsealing is shorter than that required for the unsealing in the long direction F and therefore a time required for the unsealing becomes short.

Further, a constitution in which the sealing member 19 for covering the discharging portion 35 is wound up by the unsealing member 20 is employed. The rotational axis direction of the unsealing member 20 and the direction F substantially perpendicular to the unsealing direction E are made equal, so that winding distance and time of the sealing member 13 can be shortened.

Incidentally, the arrangement of the openings 35*a* may only be required to be disposed at the different positions with respect to the direction F perpendicular so the unsealing direction E, and even when the openings 35*a* overlap with each other as shown in (c) of FIG. 28, or do not overlap with each other as shown in (d) of FIG. 28, there is an effect of the connecting portions 35*b* described later.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. Here, the downward opening of the openings 35*a* with respect to the gravitational direction refers to chat the direction of the openings 35*a* has a downward, component with respect to the gravitational direction.

(Fixing between Developer Bag and Frame)

As shown in FIG. 3, the developer bag 16 is fixed inside the first frame 17 and the second frame 18 by the two fixing portions 16*d* and 16*e*.

First, as a first fixing portion, the first, fixing portion 16*d* of the developer bag 16 where a force is received when the sealing member 19 is unsealed from the developer bag 16 as described later is provided. The first fixing portion 16*d* is provided at a plurality of positions in parallel to the direction F in which the plurality of openings 35*a* are arranged. Incidentally, other than the arrangement at the plurality of positions, the first fixing portion 16*d* may also be a single fixing portion elongated in parallel to the direction F (not shown).

Further, the position of the first fixing portion 16*d* is provided in the neighborhood of the openings 35*a*, and this first fixing portion 16*d* is fixed to a first fixing portion 18*a* of the frame.

As a second fixing portion, the second fixing portion 16*e* for preventing movement of the developer bag 16 downward or toward the developing roller 13 and the developer supplying roller 23 is provided.

This second fixing portion 16*e* is fixed to a second fixing portion 18*b* of the frame.

<Sealing Member>

As shown in FIG. 3 and FIG. 5, the sealing member 19 covers the discharging opening 35 of the developer bag 16 before use of the process cartridge A to seal the developer in the developer bag 16. The sealing member 19 is moved, so that the openings 35*a* are exposed. The structure of the sealing member 19 has a sheet-like shape including a sealing portion 19*a* for covering the discharging portion 35 of the developer bag 16, a portion-to-be-engaged 19*b* to be fixed with the unsealing member 20, and a sealing member connecting portion 19*c* which connects the sealing portion 19*a* and the portion-to-be-engaged 19*b*. The sheet is formed of a laminate material having a sealant layer which exhibits an easy-unsealing property described later, and a base material is polyethylene terephthalate (PET), polyethylene, polypropylene or the like, and a thickness may appropriately be selected from a range of 0.03-0.15 mm.

The above-described sealing member 19 is mounted by being bonded to the discharging portion 35 of the developer bag 16 in a predetermined position, but the position where the sealing member 19 is bonded to the openings 35*a* will be described later.

<Structure of Unsealing Member>

The unsealing member 20 is used for the purpose of peeling the sealing member 19 from the developer bag 16 by applying a force to the sealing member 19 to move the sealing member 19. The unsealing member 20 includes a supporting portion (not shown) which has a shaft shape (see FIG. 5) and which is rotatably supported by the second frame 18 at its ends, and includes an engaging portion 20*b* for fixing the portion-to-be-engaged 19*b* of the sealing member 19 (see FIG. 3). In this embodiment, the unseal member 20 has a rectangular shaft shape, and the portion-to-be-engaged 19*b* of the sealing member 19 is engaged with the engaging portion 20*b* at one surface of the rectangular shaft.

The above-described unsealing member 70 is rotated by drive transmission from a driving system (not shown), so that the sealing member 19 is wound up around the unsealing member 20 and thus the sealing member 19 is peeled from the developer bag 16, thereby to unseal the openings 35*a*.

<Relationship between Openings of Developer Bag and Bonded Portion of Sealing Member>

Next, arrangement of the bonded portion 22 of the sealing member 19 for hermetically sealing the developer discharging portion 35 in this embodiment will be described by using FIG. 6 to FIG. 14.

The bonded portion 22 has a rectangular shape surrounded by two lines extending in a long direction (direction F) and two lines extending in a short direction (direction F), and therefore the bonded portion 22 enables the sealing of the discharging portion 35.

Here, of the two lines of the bonded portion 22 welded with respect to the long direction (direction F), a bonded portion (located in an upstream side of the unsealing direction) which is first unsealed is referred to as a first bonded portion 22*a* and a bonded portion (located in a downstream side of the unsealing direction) which is unsealed later is referred to as a second bonded portion 22*b*. In this embodiment, in the case where the bonded portion 22 is viewed along the surface of the sealing member 19 before unsealing of the sealing member 19, the bonded portion in a side closer to a fold(ed)-back portion 19*d* (or portion-to-be-engaged 19*b*) described later is the first bonded portion 22*a*. Further, the bonded portion opposing the first bonded portion 22*a* via the opening is the second bonded portion 22*b*. Further, a bonded portion with respect to a widthwise direction is a widthwise (short) bonded portion 22*e*.

In this embodiment, an unsealing direction is the direction E. The unsealing direction is defined as follows. In the case where the unsealing is effected by moving the sealing member 19, of the first bonded portion 22*a* and the second bonded portion 22*b* opposing to each other via the opening 35*a*, the first bonded portion 22*a* is first unsealed (peeled). Thus, a direction directed from the first bonded portion 22*a* to be first unsealed toward the second bonded portion 22*b* is the unsealing direction E.

Incidentally, when the sealing member 19 is unsealed (peeled) from the developer bag 16 in the E direction, when viewed, microscopically, the peeling progresses also in the arrow F direction in some cases due to the deformation of the developer bag 16 by an unsealing force also in the first bonded portion 22*a* and the second bonded portion 22*b* . However, the unsealing direction in this embodiment does not refer to such a microscopic unsealing direction.

(Position of First Bonded Portion)

As shown in FIG. 6 and FIG. 3, the first bonded portion 22*a* is disposed at a position where it contacts an edge portion of the opening 35*a* in an upstream side of the unsealing direction. By thus disposing the first bonded portion 22*a*, it becomes possible to provide the opening 35*a* with a wide area in the unsealing direction upstream side, that it becomes possible to improve a developer discharging property.

Figure 9:
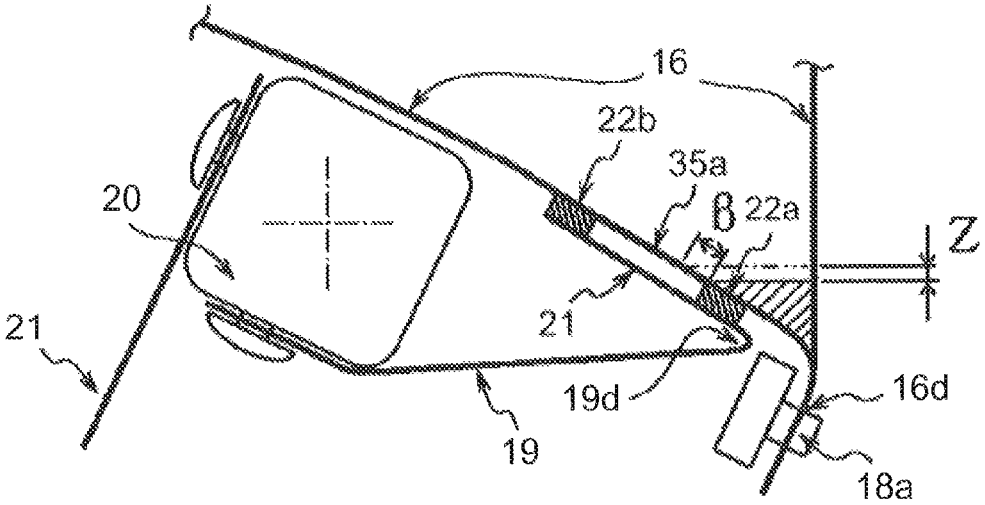
FIG. 9 is an illustration of positions of the openings and a first bonded portion and a developer stagnation portion.

Further, by providing the arrangement such that the first bonded portion 22*a* is contacted to the openings 35*a*, as shown in FIG. 9, a vertical direction lower-side edge portion (peel d erection upstream-side edge portion) of the openings 35*a* can be disposed in the fixing portion 16*d* side (lower side) to the possible extent.

That is, the first bonded portion 22*a* has to be formed between from the develop fixing portion 16*d* to the position where the first bonded portion 22*a* contacts the openings 35*a* with respect to the peeling direction. Further, the openings 35*a* are disposed in the peeling direction downstream side than the above-described first bonded portion 22*a* . Accordingly, by disposing the first bonded portion 22*a* in contact with the openings 35*a*, the openings 35*a* disposed at a lower portion of the developer accommodating member 34 can be located below (in the peeling direction upstream side) to the possible extent.

For this reason, as shown in FIG. 9, e.g., compared with the case where the vertical direction lower-side edge portion of the openings 35*a* is disposed away from the first bonded portion 22*a* by β with respect to the peeling direction, a toner surface height of the residual toner can be decreased corresponding to Z. By this, it becomes possible to effectively use the toner.

Incidentally, the above-described first bonded portion 22*a* can also be appropriately disposed at a position where it does not contact the openings 35*a* in view of an unsealing stability, so that the arrangement of the first bonded portion 22*a* is selectable depending on a required area of the openings 35*a*.

(Position of Second Bonded Portion)

Next, the second bonded portion 22*b* is, as shown in FIG. 6, disposed in an unsealing direction downstream side by being spaced from the peeling direction downstream-side edge portion of the openings 35*a* by a spacing α. Thus, by disposing the second bonded portion 22*b* in a non-contact position with the openings 35*a*, the unsealing stability of the sealing member 19 is ensured, but the reason therefor will be described later together with explanation of an unsealing operation of the sealing member 19.

<Constitution Having Easy-Unsealing Property of Sealing Member>

Figure 10:
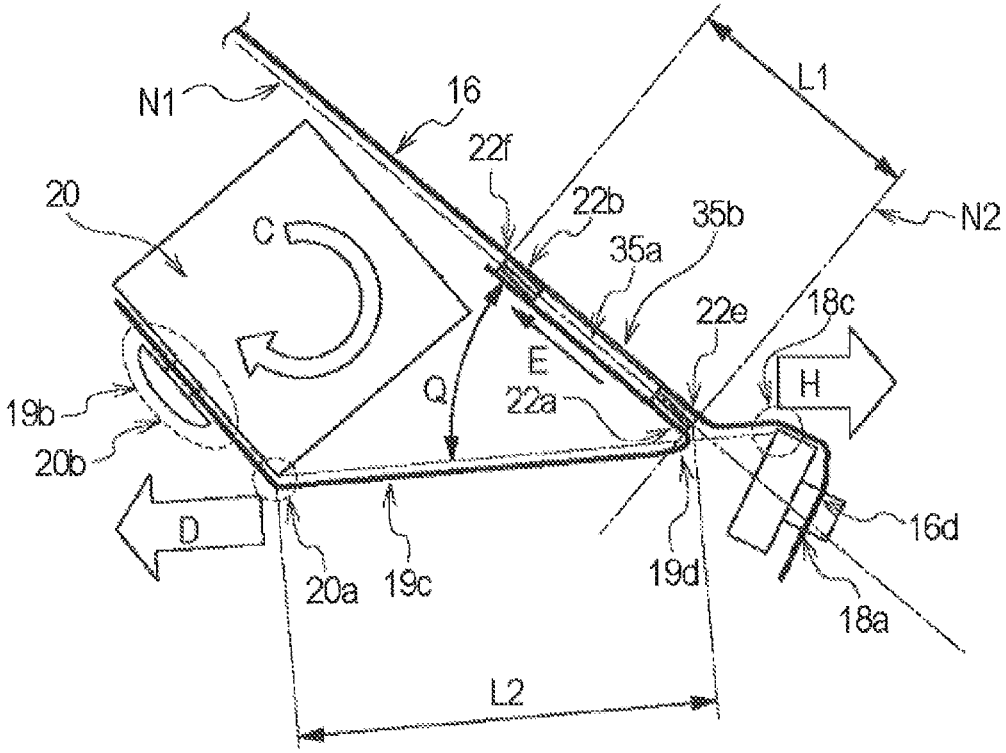
FIG. 10 is a sectional illustration of a discharging portion.

Here, as shown in FIG. 10, the sealing member 19 bonded to the developer bag 16 by the above-described bonded portion 22 is, when is wound up by the unsealing member 20, folded back so that the bonded portion can be easily peeled.

As shown in FIG. 10, a plane formed between the first bonded portion 22*a* and the second bonded portion 22*b* at the movement of the unsealing is taken as N1. A plane which is perpendicular to the plane N1 and which passes through the first bonded portion 22*a* is taken as N2. Here, the unsealing member 20 is disposed in the second bonded portion 22*b* side than the plane N2 passing through the first bonded portion 22*a*. In other words, the sealing member 19 includes, when it is seen along the surface of the sheet-like sealing member 19, a fold(ed)-back portion 19*d* where the sealing member 19 is folded back at the portion (connecting portion 19*c*) between the connecting portion 22 and the portion-to-be-engaged 19*b* engaged with the unsealing member 20. The fold-back portion 19*d* may be provided with or not provided with a fold (crease). Here, a folding angle Q of the sealing member 19 may preferably be 90 degrees or less. The folding angle Q is a narrow angle Q between a surface of the bonded portion 22 of the developer bag 16 and a surface along the direction D in which the seeding member 19 is pulled.

Further, fixing between the sealing member 19 and the unsealing member 20 is, in this embodiment, made by the ultrasonic clamping similarly as in the first fixing portion 16*d* . Other than the ultrasonic clamping, the fixing may also be made by the (heat) welding, the ultrasonic welding, the bonding, the insertion between the frames, the hooking by a hole and a projection, or the like similarly as the fixing means for the first fixing portion 16*d* and the second fixing portion 16*e*.

(Portion Having Easy-unsealing Property of Sealing Member)

Next, a method of providing a peeling force of the bonded portion 22 with a desired value will be described. In this embodiment, in order to provide the peeling force with the desired value (herein a minimal force within a range in which the toner sealing property can be maintained), two methods are principally employed.

In a first method, a laminate material having a sealant layer for enabling easy unsealing of the sealing member 19 is applied. Further, the first method is a method in which the easy unsealing is enabled at the bonded portion by applying, as the material for the developer bag 16, a sheet material (of, e.g., polyethylene or polypropylene) which is weldable with the sealant layer and which has flexibility. By changing a combination of formulation of the sealant layer with the material to be bonded, the peeling force can be adjusted correspondingly so a desired condition, in this embodiment, a material having a peeling strength of about 3N/15 mm measured by testing methods for hermetically sealed flexible packages of JIS-Z0238 is used.

A second method is a method in which as shown in FIG. 3, the discharging portion 35 of the developer bag 16 is placed in a state in which the sealing member 19 is folded back with respect to an unsealing advancing direction (arrow E in the figures). For example, in the state of FIG. 3, the unsealing member 20 is rotated (an arrow C in the figure), so that the sealing member 19 is pulled in a pulling direction (arrow D in the figure) by the unsealing member 20. By doing so, the developer bag 16 and the sealing member 19 provide an inclined peeling positional relationship, as shown in FIG. 10, in which the narrow angle Q between the surface of the bonded portion 22 of the developer bag 16 and the surface along the pulling direction D of the sealing member 19. It has been conventionally known that the peeling force necessary to pull off the both surfaces can be reduced by effecting the inclined peeling. Accordingly, as described above, the sealing member 19 is placed in the folded-back state with respect to the unsealing advancing direction (arrow E in the figure), so that the sealing member 19 at the bonded portion 22 and the developer bag 16 are placed in the inclined peeling positional relationship, and the peeling force can be adjusted so as to be reduced.

<Summary of Unsealing of Developer Bag>

The unsealing operation of the developer bag 16 will be described with reference to FIG. 11 and FIG. 12.

The developing device 38 includes a power application point portion 20*a* where the unsealing member 20 applies the force for pulling the sealing member 19 in order to effect the unsealing, and includes the fixing portion 18*a* of the frame for fixing the developer bag 16 to be pulled.

The power application point portion 20*a* is a portion, closest to the bonded portion 22, of a portion where the sealing member 19 and the unsealing member 20 contact at the moment of the unsealing. In (b) of FIG. 11, a corner portion 20*c* of the unsealing member is the power application point portion 20*a*. The fixing portion 18*a* of the second frame 18 includes a fixing portion 18*c* for suppressing movement of the developer bag 16 caused by the force during the unsealing. Further, from the bonded portion 22, in this embodiment, the first fixing portion 18*a* of the frame and the first bonded portion 16*d* of the developer bag are bonded by the ultrasonic clamping, and as shown in (b) and (c) of FIG. 11 and (a) of FIG. 12, a portion, near the bonded portion 22, of the ultrasonic clamping portion of the first fixing portion 18*a* constitutes the fixing portion 18*c*.

First, the unsealing member 20 is rotated in the arrow C direction by transmission of the driving force thereto from the main assembly by an unshown driving means.

Then, the sealing member 19 is pulled by further rotation of the unsealing member 20 to start the unsealing of the first bonded portion 22*a* . A state immediately before the start of the unsealing is shown in (b) of FIG. 11. With the rotation of the unsealing member 20, the sealing member 19 is pulled in the arrow D direction by the corner portion 20*c* (power application point portion 20*a*) of the rectangular unsealing member 20.

When the sealing member 19 is pulled, the developer bag 16 is pulled via the bonded portion 22. Then, a force is applied to the first fixing portion 16*d* of the developer bag 16, so that the developer bag 16 is pulled from the fixing portion 18*c* toward the power application point portion 20*b*. Then, in a cross section perpendicular to the rotation shaft of the unsealing member 20, the first bonded portion 22*a* is moved so as to approach a line connecting the power application point portion 20*a* and the fixing portion 18*c* . At this time, with respect to the arrow D direction, from a side close to the rotation shaft of the unsealing member 20, the portions are disposed in the order of the openings 35*a*, the first bonded portion 22*a*, the fold-back portion 19*d* and the fixing portion 18*c* ((b) of FIG. 11). Further, the unsealing member 19 is folded back between the first bonded portion 22*a* and the portion-to-be-engaged 19*b* and therefore the force is applied to the portion of the first bonded portion 22*a* so as to be inclination-peeled in the arrow D direction. Then, the peeling of the first bonded portion 22*a* is effected to start the unsealing of the discharging portion 35.

Thus, a force when the first bonded portion 22*a* is peeled is to be received in a process of being exerted on the fixing portion 16*d* by the developer bag 16 in the entire region between the first bonded portion 22*a* and the fixing portion 16*d*. By this, it becomes possible to effect stable peeling without largely deforming the developer bag 16.

Accordingly, with respect to the peeling of the first bonded portion 22, irrespective of whether or not the first bonded portion 22 contacts the openings 35*a*, stable peeling can be made.

Further, together with the corner portion 20*c*, also the power application point portion 20*a* is moved in the arrow C direction, and when the sealing member 19 contacts a corner portion 20*d*, the power application point portion 20*a* is moved from the corner portion 20*c* to the corner portion 20*d*. Here, (b) of FIG. 11 shows a state in which the power application point portion 20*a* is the corner portion 20*c*, and (c) of FIG. 11 shows a state in which the unsealing member 20 in further rotated and the power application point portion is moved to the corner portion 20*d*.

Figure 11:
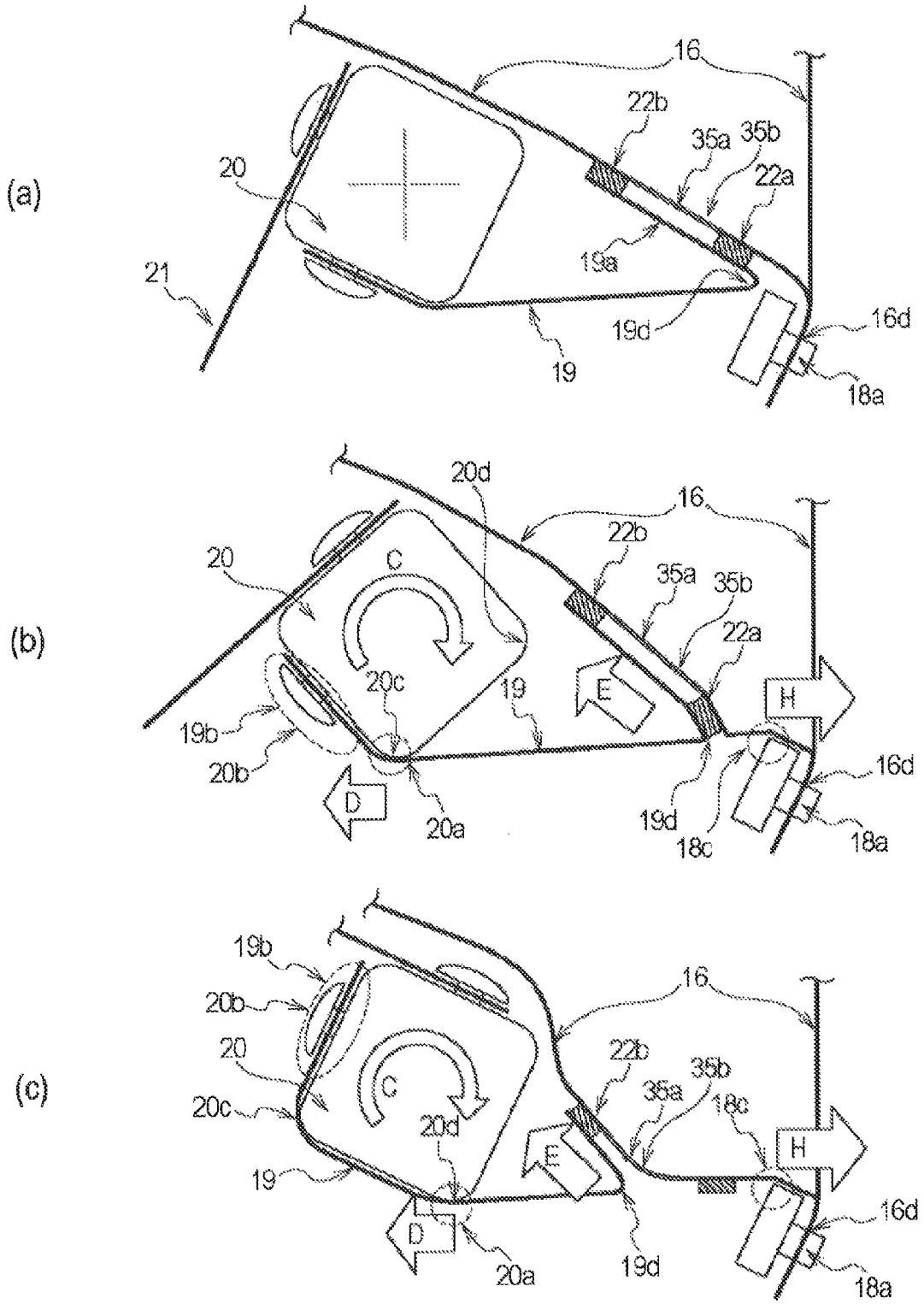
FIG. 11 is a sectional view for illustrating an unsealing process of the discharging portion.

As shown in (c) of FIG. 11, together with advance of the unsealing of the sealing member 19 with further rotation of the unsealing member 20, also the fold-back portion 19*d* advanced in the arrow E direction. Then, the unsealing further advances, so that the openings 35*a* are exposed. A state in which he peeling of the second bonded portion 22*b* is to be started after the openings 35*a* are exposed is shown in (a) of FIG. 12. Also at this time, similarly as the peeling of the first bonded portion 22*a*, the sealing member 19 is pulled toward the power application point portion 20*a*, and the developer bag 16 stands firm toward a direction of the fixing portion 18*c* (arrow H). Then, in a cross section perpendicular to the rotation shaft of the unsealing member 20, the second bonded portion 20*b* is moved so as to approach a line connecting the power application point portion 20*a* and the fixing portion 18*c* . Then, the force is applied to the portion of the bonded portion 22*b* in the arrow D direction, so that the second bonded portion 22*b* is peeled.

(Action of Second Bonded Portion on Openings when Sealing Member is Peeled)

Here, action of the second bonded portion 22*b* on the openings 35*a* when the second bonded portion 22*b* is peeled from the developer bag 16 by moving the sealing member 19 will be described by using FIG. 13 and FIG. 14.

Figure 12:
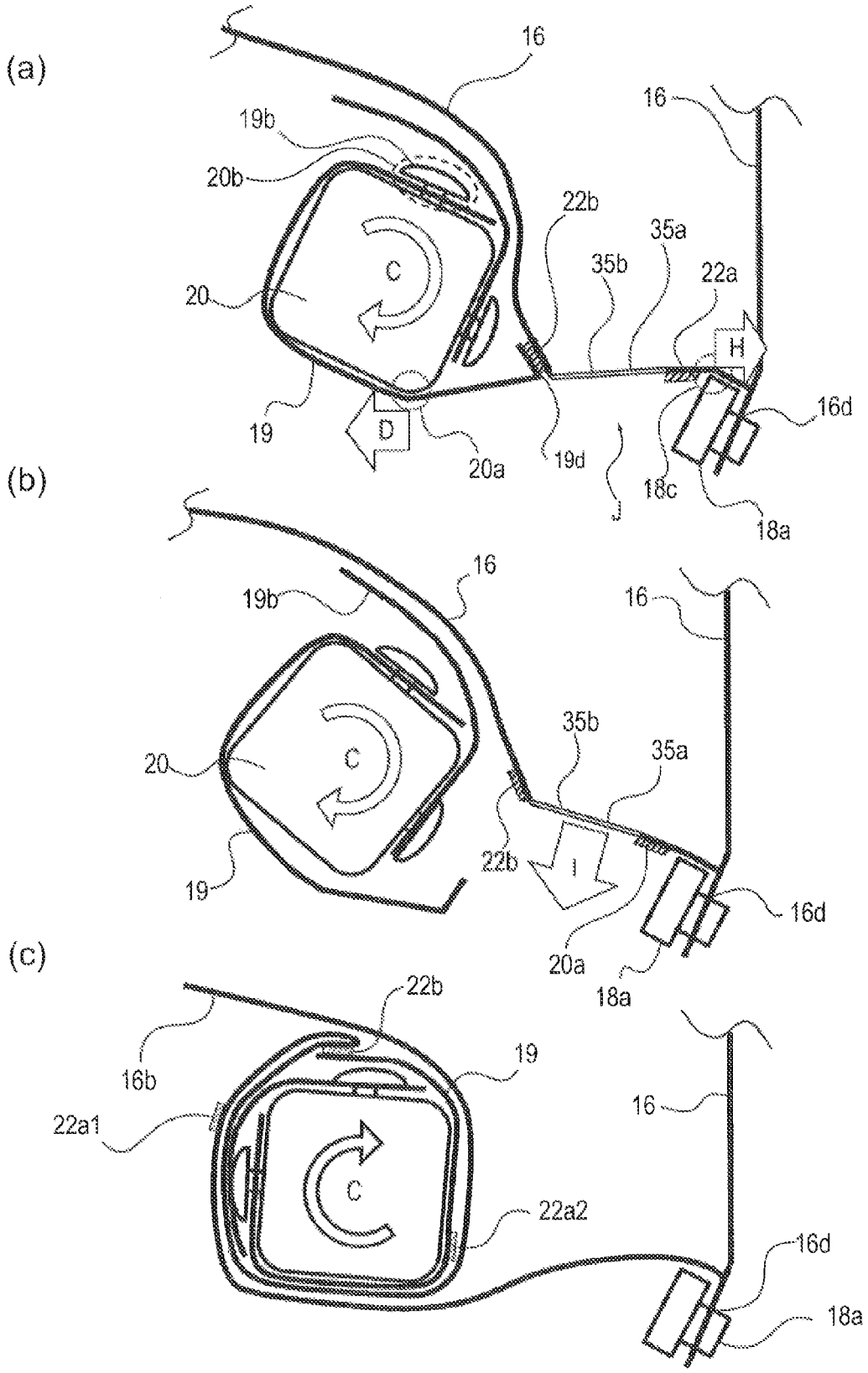
FIG. 12 includes sectional views for illustrating the unsealing process of the discharging portion.
Figure 13:
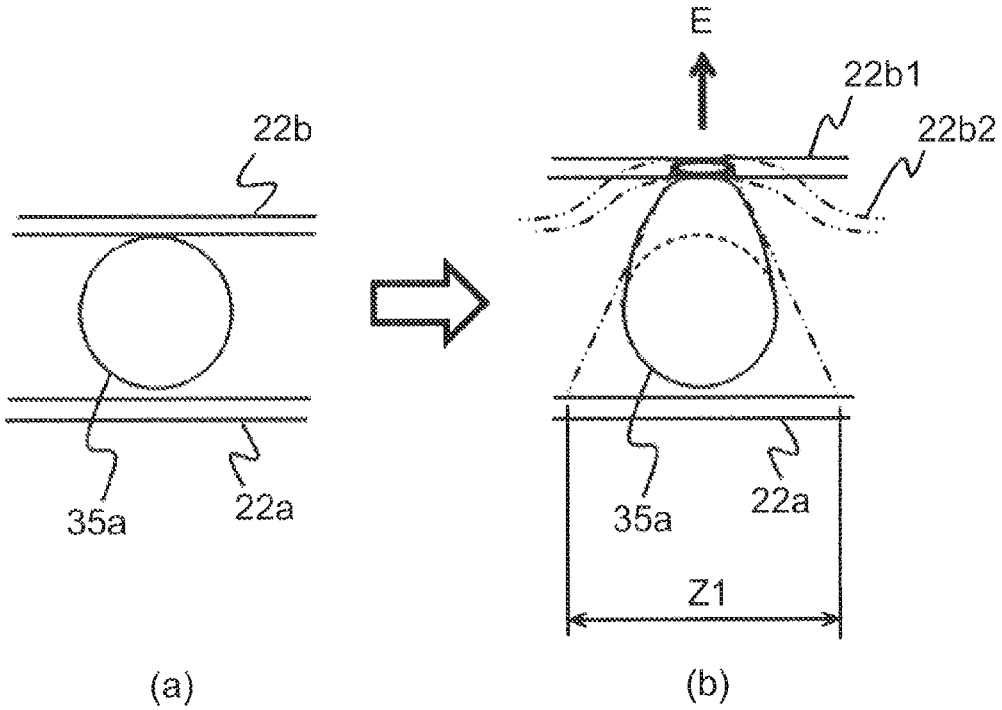
FIG. 13 includes illustrations in the case where a second bonded portion is contacted to the opening.

FIG. 13 includes plan views in the neighborhood of the opening 35*a* as seen from an arrow J direction in a stats in which the second bonded portion 22*b* shown in (a) of FIG. 12 is peeled, and includes views showing a state in which the second bonded portion 22*b* is disposed in contact with the opening 35*a*.

Figure 14:
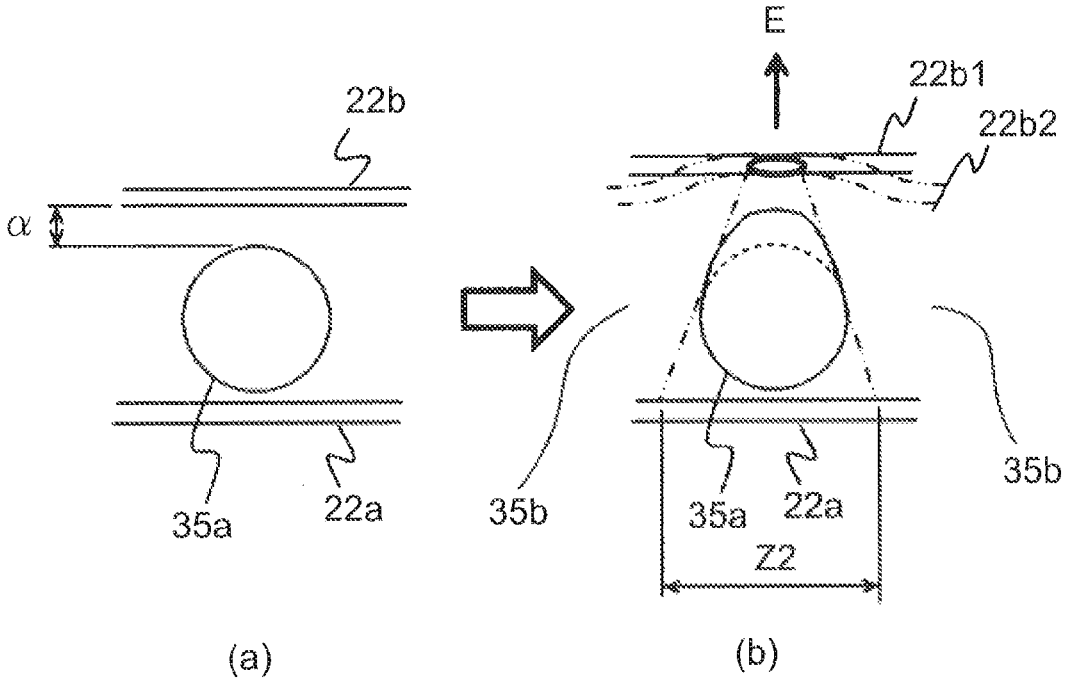
FIG. 14 includes illustrations in the case where the second bonded portion is not contacted to the opening.

FIG. 14 includes plan views in the neighborhood of the opening 35*a* as seen from the arrow J direction in the state in which the second bonded portion 22*b* shown in (a) of FIG. 12 is sealed, and includes views showing a state in which the second bonded portion 22*b* does not contact the opening 35*a* and is spaced from the peeling direction downstream-side edge portion of the opening 35*a* by a distance α. Here, 22*b*1 shows the second bonded portion remaining on the sealing member 19, and 22*b*2 shows the second bonded portion remaining on the developer bag 16.

As shown in FIG. 13 and FIG. 14, the peeling advance direction of the second bonded portion 22*b* goes toward the neighborhood of the center of the opening 35*a* with movement in the E direction which is an original peeling direction by deformation of the opening 35*a* . Accordingly, a final peeling portion of the second bonded portion 22*b* at the opening 35*a* is the neighborhood of the center of the opening 35*a*.

In this situation, as shown in (b) of FIG. 13, in the state in which the second bonded portion 22*b* contacts the opening 35*a*, in a region Z1 where rectilinear lines each connecting the final peeling portion and an outer configuration of the opening 35*a* cross the first bonded portion 22*a*, stress is blocked by the opening 35*a*, so that a region where the developer bag 16 cannot receive the unsealing force on a line of the second bonded portion 22*b* is created. On the other hand, of the stress to be originally received by the developer bag 16, the stress corresponding to the Z1 region is received by the opening 35*a* . For this reason, the shape of the opening 35*a* is largely deformed, so that it cannot be said that the unsealing stability is sufficient.

Therefore, in this embodiment, the second bonded portion 22*b* is disposed so as not to contact the opening 35*a*, whereby the stress to be exerted, on the opening 35*a* is dispersed into the connecting portions 35*b* each located between the respective openings 35*a* to make the deformation of the opening 35*a* small.

Specifically, as shown in FIG. 14, the second bonded portion 22*b* is spaced from the opening 35*a* by the distance α. For this reason, a region 22 in which rectilinear lines each connecting the final peeling portion and the outer configuration of the opening 35*a* cross the first bonded portion 22*a* is a region narrower than the above-described region Z1 (see FIG. 13) in the case where the second bonded portion 22*b* contacts the opening 35*a*.

By this, stress corresponding to a region obtained by subtracting Z2 from Z1 is to be exerted on the developer bag 16, with the result that the stress exerted on the opening 35*a* becomes smaller than that in the state in which the opening 35*a* and the second bonded portion 22*b* contact each other. For this reason, the deformation of the opening 35*a* can be suppressed, so that the unsealing stability is improved.

Incidentally, an upper limit of the distance α between the second bonded portion 22*b* and the opening 35*a* is, in the sealing member, an end surface in an opposite side to the unsealing member 20 in the above-described sealing member unsealing direction E.

Further, the upper limit of the distance α between the second bonded portion 22*a* and the opening 35*a* is, as shown in (c) of FIG. 12, a position when the peeling force of the second bonded portion 22*b* does not act by a frictional force generated by the winding-up of the second bonded portion 22*b* around the unsealing member 20 as a winding-up shaft and a frictional force of the second bonded, portion 22*b* sandwiched between the main material 16*b* of the developer bag and the sealing member.

In actual design, in consideration of the above, by setting a maximum distance α in which the second bonded portion 22*b* is not shearing-peeled, the deformation of the opening 35*a* is effectively suppressed and it becomes possible to obtain the unsealing stability. Then, the second bonded portion 22*b* is peeled to complete the unsealing (see (b) of FIG. 12). Then, the developer inside the developer bag 16 passes through the openings 35*a* of the discharging portion 35, and is disposed in an arrow I direction.

Thus, the sealing member 19 is wound up around the unsealing member 20 by the rotation of the unsealing member 20, so that the bonded portion 22 is unsealed. The sealing member 19 is wound up by the rotation and therefore a space required to move the unsealing member 20 may only be required to be a rotation space, and compared with the case where the sealing member 19 is moved by movement other than the rotation, it is possible to realize space saving.

By providing the sealing member 19 with the fold-back portion 19*d*, the bonded portion 22 can be inclination-peeled without effecting shearing peeling and can be unsealed with reliability.

Further, the portion-to-be-engaged (19*b*), to be engaged with the unsealing member 20, for unsealing the sealing member 19 in an end side of the sealing member 19 with respect to a direction substantially perpendicular to the direction F in which the plurality of openings 35*a* are arranged is provided, so that the sealing member 19 can be engaged and unsealed with reliability.

Further, by providing the frame with the fixing portion 18*c*, the developer bag 16 is supported during the unsealing, so that even a soft and deformable developer bag 16 becomes unscalable with reliability.

Further, with respect to the discharge of the developer during the unsealing, as described above, the bonded portion 22 is moved on the line connecting the power application point portion 20*a* and the fixing portion 18*c* (in the order of (a) of FIG. 11, (b) of FIG. 11, (c) of FIG. 11 and (a) of FIG. 12). By this motion, the developer at the periphery of the openings 35*a* is moved, so that agglomeration of the developer can be broken.

(Arrangement of Fixing Portion of Developer Bag for Unsealing)

As shown in FIG. 3, in order to peel off the first bonded portion 22*b* with reliability, the following arrangement relation is required between the first bonded portion 22*b* and the fixing portion 18*c*. During the unsealing, with respect to the fixing portion 18*c*, the unsealing member 20 pulls the sealing member 19 in the arrow D direction. At this time, with to the movement direction B of the sealing member 19 by the unsealing member 20, the fixing portion 18*c* is provided in an upstream side of the openings 35*a*. For that reason, a force is applied to the fixing portion 18*c* in the arrow H direction (see FIG. 11). Therefore, when the unsealing force is applied, the sealing member 19 is pulled in the arrow H direction and the arrow D direction between the fixing portion 18*c* and the unsealing member 20 to apply a force to the first bonded portion 20*a*, thus advancing the unsealing in the arrow E direction. Thus, if the fixing portion 18*c* is not provided upstream with respect to the movement direction D of the sealing member 19, the entire developer bag 16 is pulled in the direction in which the unsealing member 20 is pulled, so that the force cannot be applied to the first bonded portion 22*a* and the unsealing cannot be effected.

In this way, the fixing portion 18*c* is provided upstream with respect to the movement direction D of the sealing member 19, so that reliable unsealing becomes possible.

Figure 15:
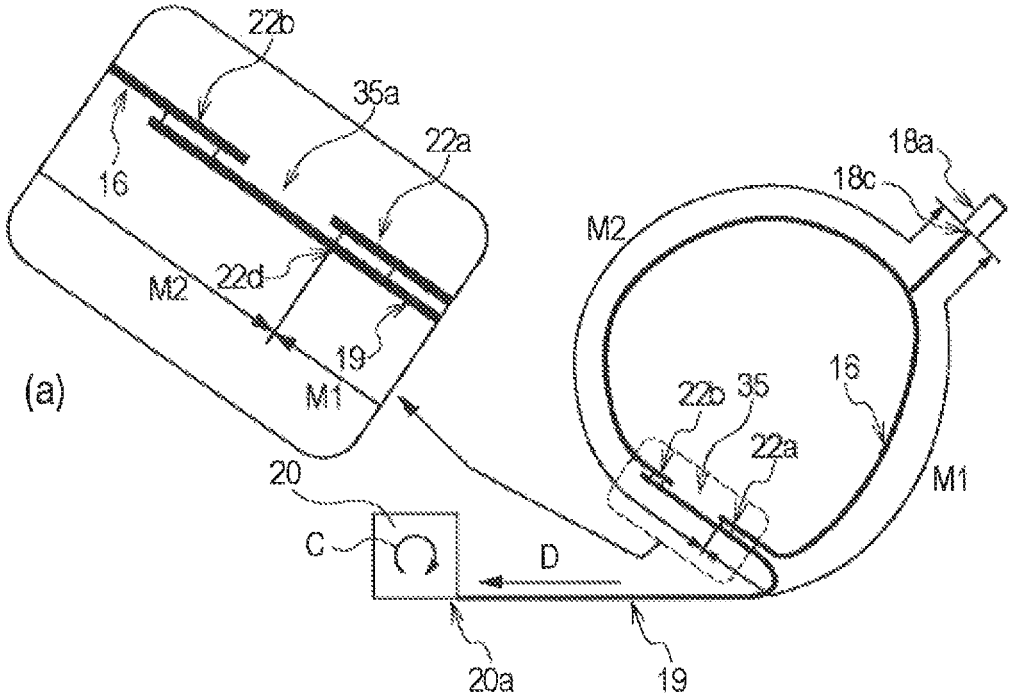
FIG. 15 includes illustrations of a developer accommodating container which is not an embodiment of the present invention.
Figure 15:
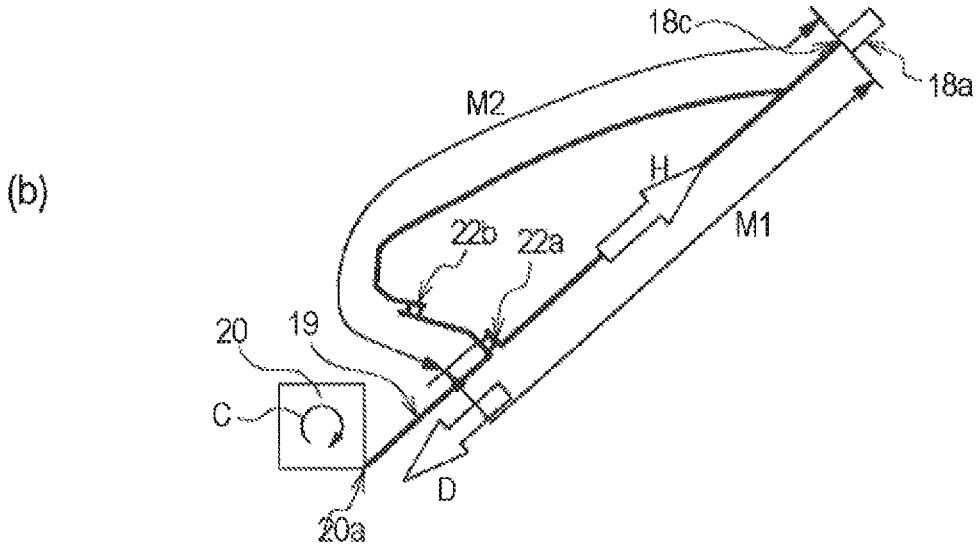
Figure 16:
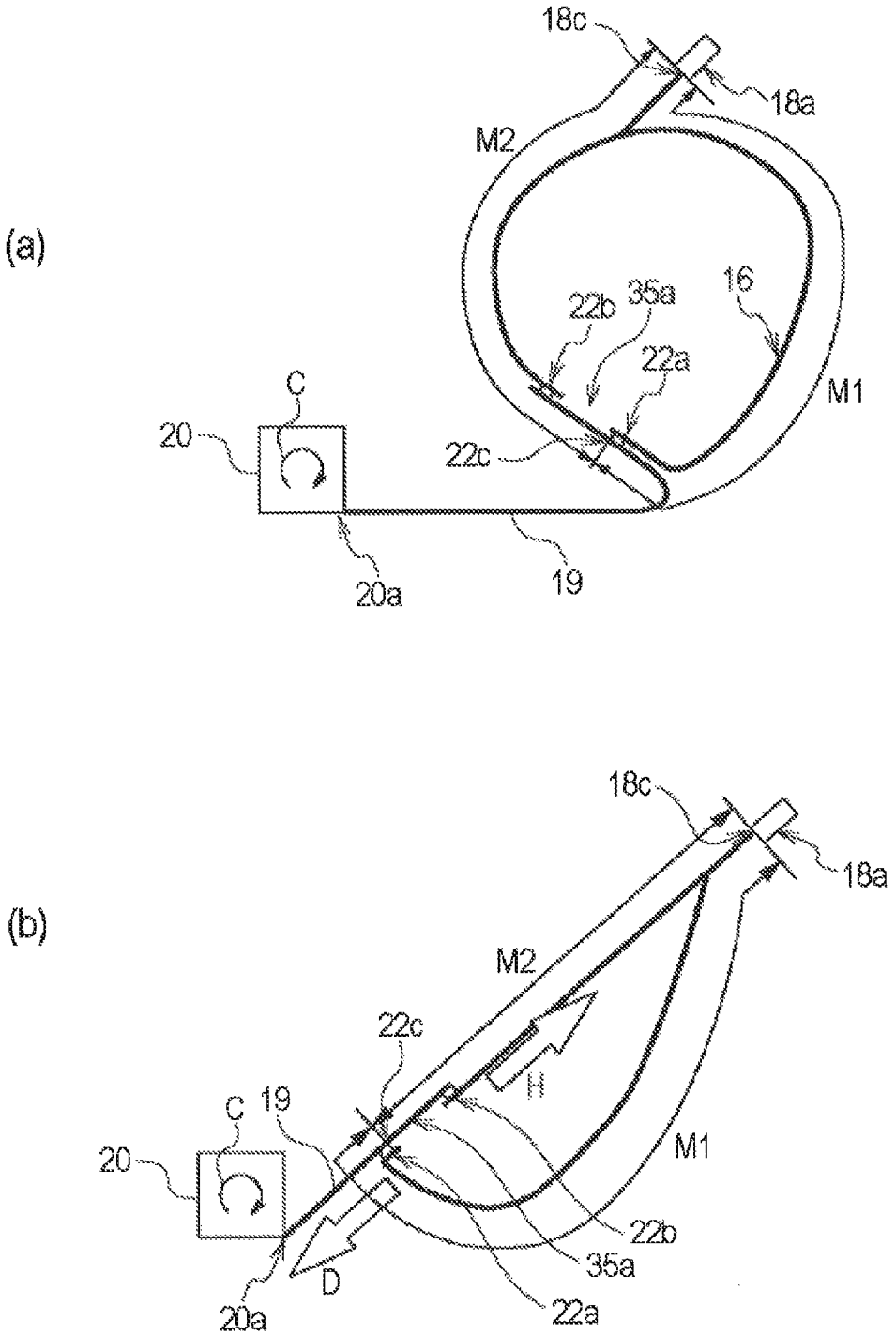
FIG. 16 includes illustrations of the developer accommodating container.

As shown in FIG. 15 and FIG. 16, in order to peel off the first bonded portion 22*b* with reliability, the following length relationship is required between the first bonded portion 22*a* and the fixing portion 18*c* . First, a point of the first bonded portion 22*a* finally peeled off when a flat surface which passes the unsealing member 20, the openings 35*a* and the fixing portion 18*c* and which is perpendicular to the rotation shaft of the unsealing member 20 is viewed, is a first point 22*d*. The first point 22*d* is an end portion point of the first bonded portion 22*a* close to the openings. Further, a distance from the fixing portion 18*c* to the first point 224 along the developer bag 16 is M1. Further, a distance measured, from the first fixing portion 18*d* to the first point 22*d*, along the developer bag 16 with respect to the direction including the openings 35*a* is M2. Incidentally, the openings 35*a* are a space in which the material for the developer bag 16 is not present but a width of the openings 16*a* is also included in the distance.

At this time, M1<M2 is satisfied to permit the peeling-off of the first bonded portion 22*a*. Here, the above relationship of M1<M2 will be described specifically.

First, in the case where M1<M2 is satisfied, as shown in FIG. 15, a force (arrow D) for pulling the sealing member 19 to the first bonded portion 22*a* by the unsealing member 20 and a retaining force (arrow H) of the fixing portion are applied to the first bonded portion 22*a*, so that the first bonded portion 22*a* can be inclination-peeled. By effecting the inclination peeling, the peeling force can be set at a low level, here, (a) of FIG. 15 shows before the unsealing, and (b) of FIG. 14 shows immediately before the first bonded portion 22*a* is unsealed.

On the other hand, in the case of M1>M2, as shown in FIG. 16, the pulling force by the unsealing member 20 is not applied to the first bonded, portion 22*a* but is applied to the second bonded portion 22*b*. In this case, the force is not applied to the first bonded portion 22*a* and therefore the first bonded portion 22*a* is not peeled. In this case, the force (arrow D) from the unsealing member 20 and the retaining force (arrow H) of the fixing portion 18*c* are applied to the second bonded portion 22*b*. In this state, to the second bonded portion 22*b*, the force (arrow D) for pulling the sealing member 19 by the unsealing member 20 and the retaining force (arrow H) of the fixing portion 18*c* (in the arrow H direction) are applied, and at the portion of the second bonded portion 22*b*, the peeling relationship is a shearing peeling relationship and therefore it is difficult to unseal the second bonded portion 22*b* . This is because the shearing peeling requires a large force compared with the inclination peeling.

Here, (a) of FIG. 16 is a view before the unsealing, and (b) of FIG. 16 is a view when the force (arrow D) for pulling the sealing member 12 by the unsealing member 20 is applied to the bonded portion (the second bonded portion in this case) by the rotation of the unsealing member 20. Further, to the second bonded portion 22*b*, the force is applied but is applied based on the shearing peeling relation, and therefore compared with the case of the inclination peeling, a very large force is required, so that it becomes difficult to reduce the peeling force.

Figure 17:
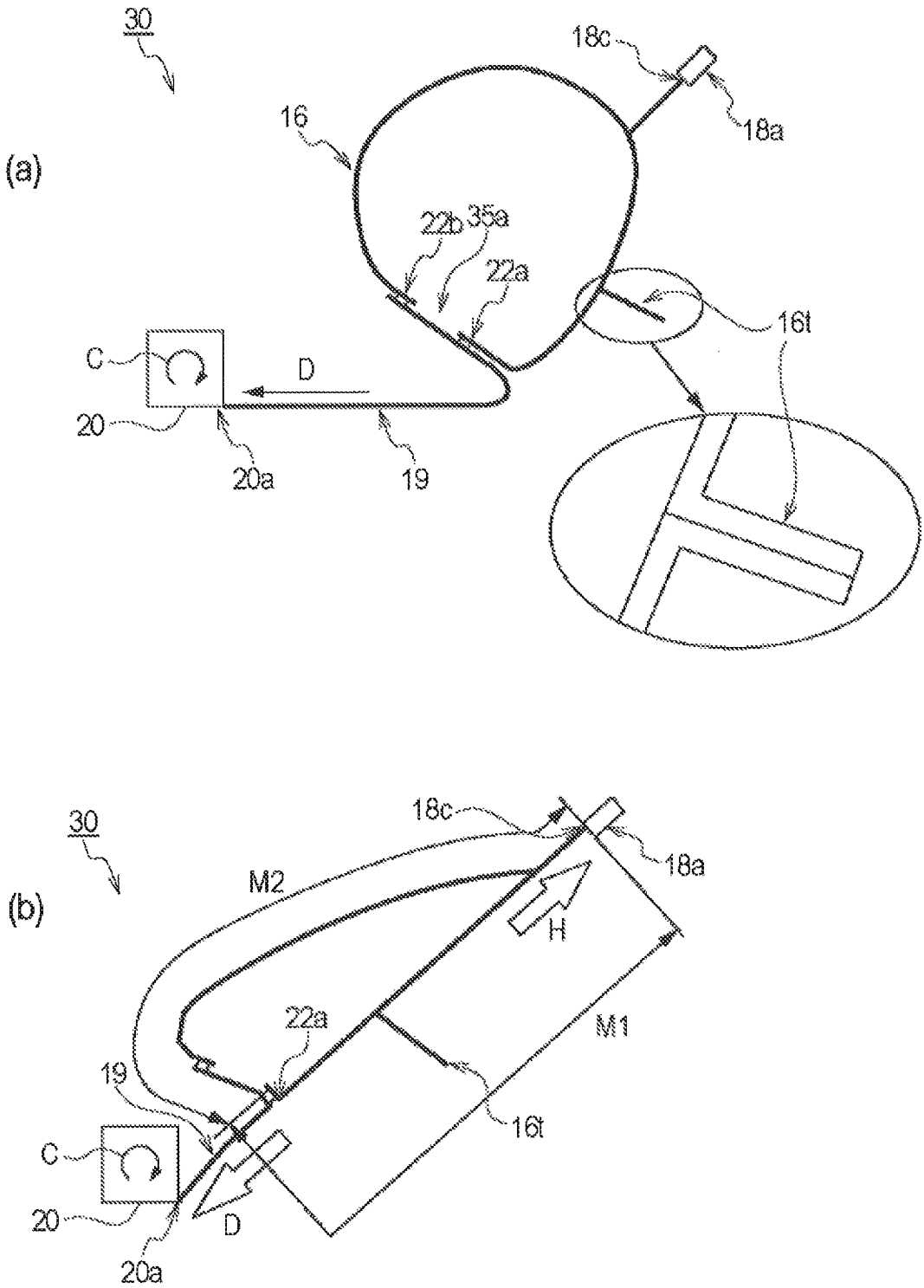
FIG. 17 includes illustrations of the developer accommodating container.

Incidentally, here, definition of a manner of measuring the above-described distances M1 and M2 will be described. The distances M1 and M2 are important when the sealing member 19 is pulled during the unsealing. In the case where there is no projection rib 16*t* at an intermediate position of paths of M1 and M2, the distances developed as shown in FIG. 15 and FIG. 16 may only be required to be measured. Further, as shown in FIG. 17, in the case where there is the projection 16*t* formed, by bonding in manufacturing, at the intermediate position of the paths of M1 and M2, even when the sealing member 16 is pulled during the unsealing, the projection 16*c* is not elongated (peeled off) and therefore the portion of the projection 16*t* is not included in the distances M1 and M2. That is, the portion, such as the projection 16*t*, which does not affect transmission of the force is not included in the distances M1 and M2.

As described above, based on the relationship of M1<M2, the first bonded portion 22*a* is unsealed earlier than the second bonded portion 22*b* . By the earlier unsealing of the first bonded portion 22*a* than the second bonded portion 22*b*, the fold-back portion 19*d* of the sealing member 19 can be provided at the first bonded portion 22*a*. By this fold-back portion 19*d*, the peeling is not the shearing peeling but is the inclination peeling. By this, with reliability, the sealing member 19 can be peeled off from the developer bag 16, so that it is possible to provide an unsellable developing device 38.

Figure 18:
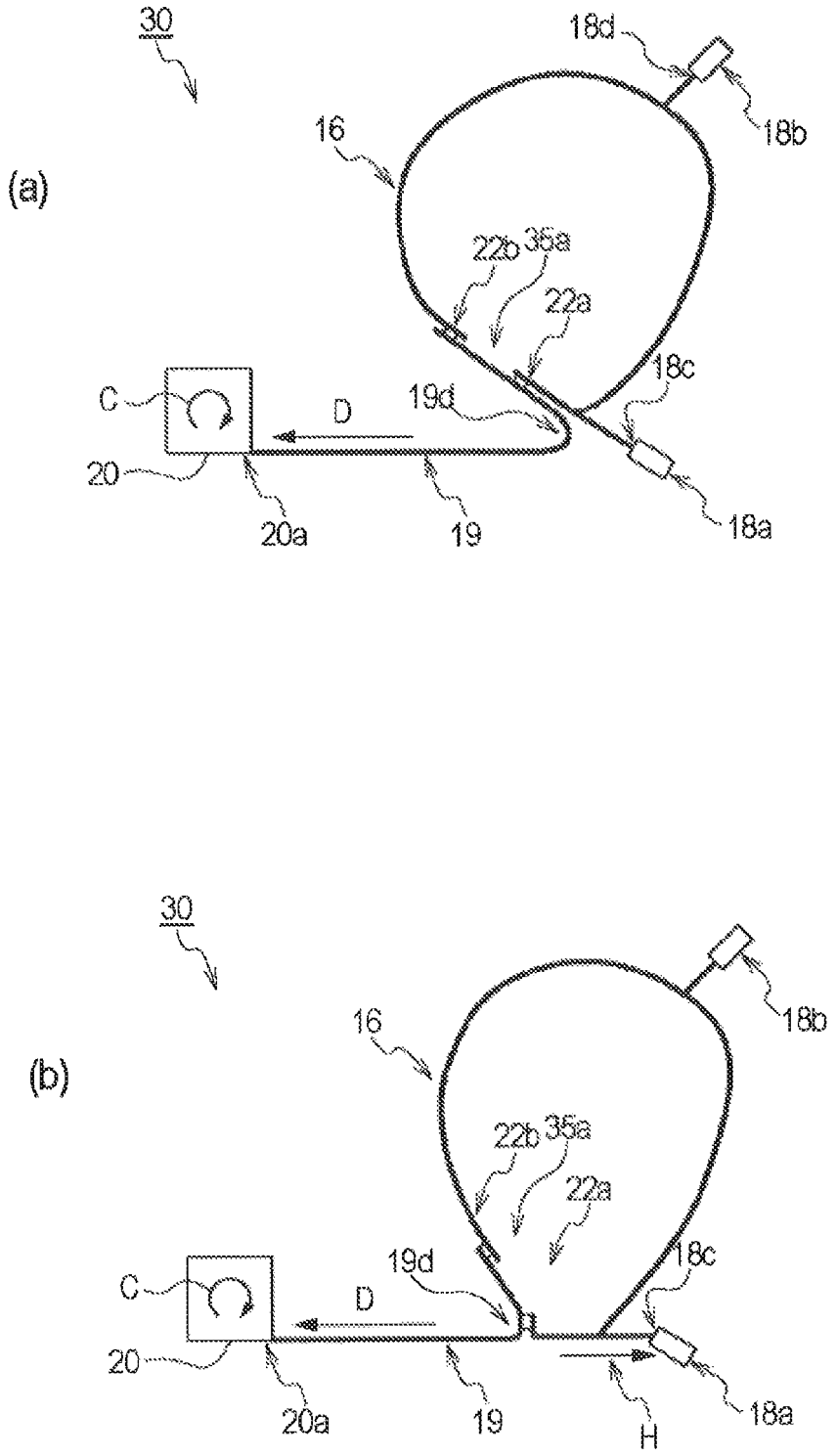
FIG. 18 includes illustrations of the developer accommodating container including an unsealing member.

Here, a relation between a plurality of fixing portions and the unsealing will be described by using FIG. 18. Immediately, before the unsealing member 20 is rotated from a state of (a) of FIG. 18 to unseal the first bonded portion 22*a* is (b) of FIG. 18. In this embodiment, the first fixing portion 18*a* and the second fixing portion 18*b* are provided. Here, the force during the unsealing is applied to the first fixing portion 19*a* disposed, at a place close to the first bonded portion 22*a* which is first unsealed while sandwiching the openings 35*a* between the portions 22and 22*b*. For that reason, the second fixing portion 18*a* is not required to be takes into consideration of the measuring manners of the distances M1 and M2 described above. Thus, in the case where there are the plurality of fixing portions, the fixing portion disposed at the place close to the first bonded portion 22*a* which is first unsealed while sandwiching the openings 35*a*, between the portions

22*a* and 22*b*, to which the force during the unsealing is to be applied may be used as a basis (of the unsealing).

An arrangement in which the second bonded portion 22*b* can be more satisfactorily unsealed without being wound up around the unsealing member 20 will be described by using FIG. 10 shows a state immediately before the first bonded portion 22*a* is unsealed. First, an end portion of the first bonded portion 22*a* in a side remote from the openings 35*a* is a second point 22*e*. An end portion of the second bonded portion 22*b* in a side remote from the openings 35*a* is a third point 22*f*. Here, a distance from the second point 22*e* to the third point 22*f* is L1. Further, a distance from the second point 22*e* to the power application point portion 20*a* is L2. At this time, a relationship between the distance L1 and the perpendicular to L2 needs a relationship of L1<L2.

The reason thereof is that an the case where L1 is distance L2, the second bonded portion 22*b* reaches the power application point portion 22*a* before the peeling of the second bonded portion 22*b* is ended, and the second bonded portion 22*b* is wound about the unsealing member 20. The force cannot be applied so as to peel off the sealing member 19 from the second bonded portion 22*b*. For that reason, it becomes difficult to unseal the sealing member 19 from the developer bag 16.

As described above, the relationship between the distance L1 and the distance L2 is made L1<L2, the sealing member 19 is satisfactorily unscalable without being wound about the unsealing member 20.

<Plurality of Openings and Connecting Portions Connecting Openings>

Next, the connecting portions 35*b* of suppressing the deformation of the openings 35*a* in the unsealing operation of the developer bag 16 will be described.

Figure 7:
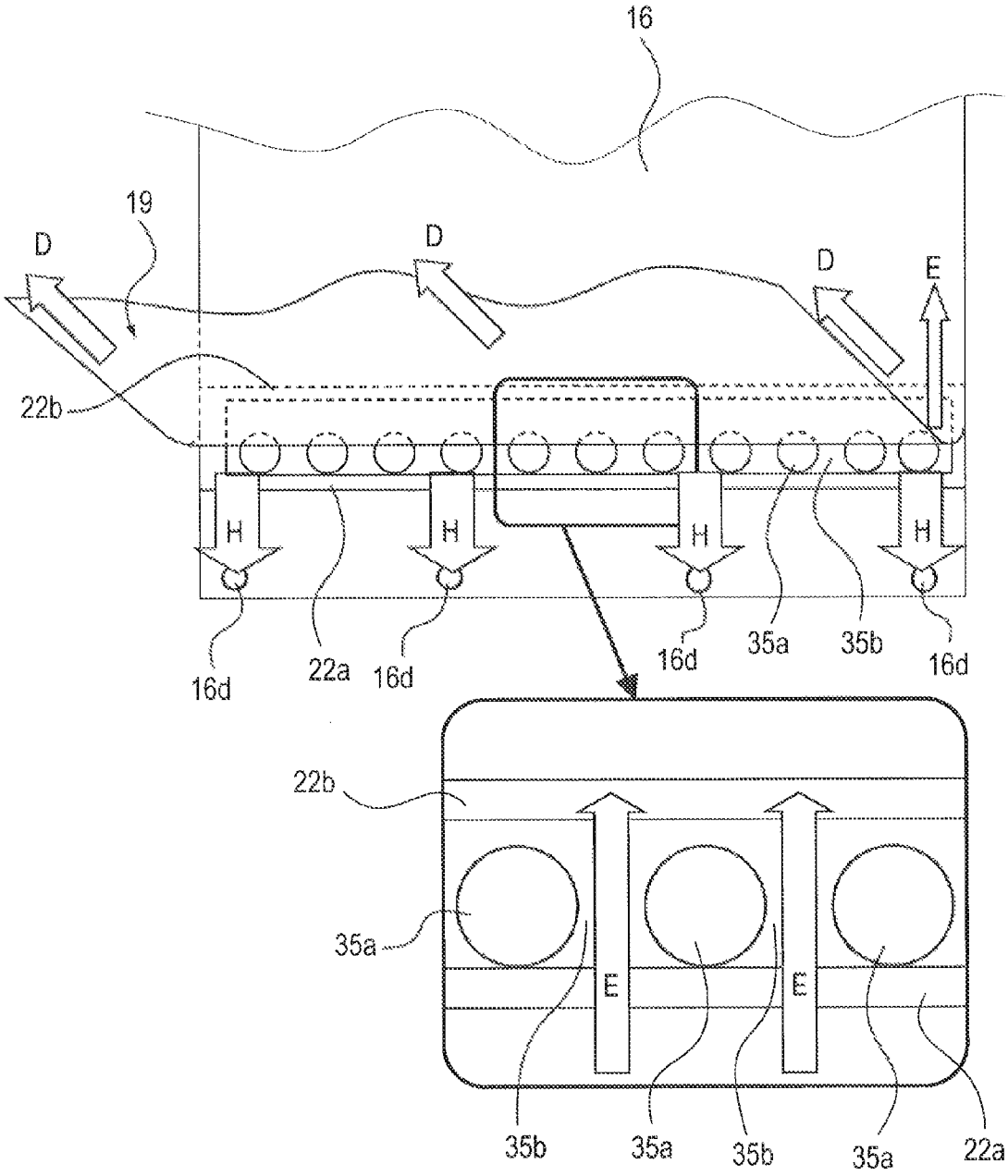
FIG. 7 is an illustration of the developer accommodating container during unsealing.

FIG. 7 is a view of the discharging portion 35 when the peeling of the portion, at the first bonded portion 22*a*, to be first unsealed is ended to expose the openings 35*a*, and is a state in which the peeling at the second bonded portion 22*b* is not ended. As described above, the discharging portion 35 includes the plurality of openings 35*a* disposed at different positions with respect to the direction F perpendicular to the unsealing direction E in which the exposure of the openings 35*a* advances. For that reason, also the plurality Of connecting portions 35*b* defining the plurality of openings 35*a* are disposed, at a plurality of positions with respect to the F direction. By this, the plurality of connecting portions 35*b* bridge the first bonded portion 22*a* and the second bonded portion 22*b* with, respect to the direction E in which the unsealing of the openings 35*a* advances. Accordingly, at the time when the unsealing of the first bonded portion 22*a* is ended (state of (a) of FIG. 12), the force when the second bonded portion 22*b* is unsealed can be received by the first fixing portion 16*d* via the connecting portions 35*b*, so that the force for peeling off the sealing member 19 from the developer bag 16 can be transferred. That is, the forces are applied to the second bonded portion 22*b* in the directions of the arrow D and the arrow E, so that also at the second bonded portion 22*b*, the sealing member 19 is peelable.

Figure 8:
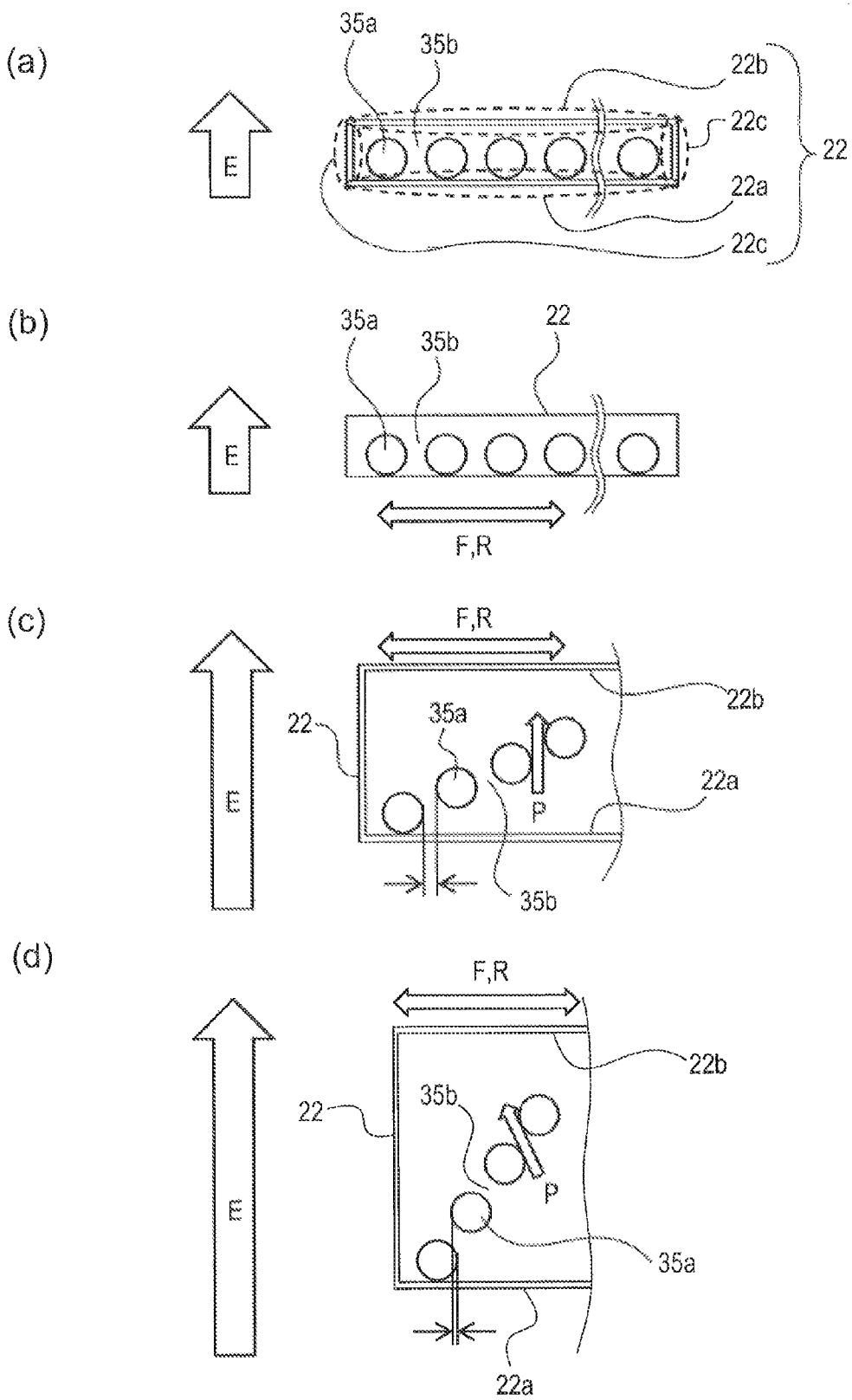
FIG. 8 includes illustrates of openings of the developer accommodating container.

A similar effect can be obtained also in cases other than the case where the openings 35*a* are arranged in the direction perpendicular to the unsealing direction B as shown in (b) of FIG. 8 as described above. Even when the openings 35*a* are not completely arranged in the direction perpendicular to the unsealing direction E as shown in (c) of FIG. 8, the connecting portions 35*b* can transmit the force, for peeling off the sealing member 19 from the developer bag 16, as shown by an arrow P. Further, even when the openings 35 overlap with each other with respect to the unsealing direction E as shown in (d) of FIG. 8, the connecting portions 35*b* can transmit the force, for obliquely peeling the sealing member 19 from the developer bag 16, as shown by an arrow P. That is, the plurality of openings 35*a* may only be required to be disposed at different positions with respect to the direction F perpendicular to the unsealing direction H.

Further, as shown in (b) of FIG. 8, a portion including the connecting portions 35*b* at a periphery of the openings 35*a* may also be used as the bonded portion 22. Also in this case, by the presence of the connecting portions 35*b*, the force can be transmitted to the end of the peeling at the bonded portion 22, so that the unsealing is effected with reliability.

Further, as for a relationship between the rotation shaft of the unsealing member 20 and the openings 35*a*, it can be said that the openings 35*a* are disposed at the different positions with respect to the direction R of the rotation shaft of the unsealing member 20. By doing so, the connecting portions 35*b* for bridging the first and second bonded portions 22*a* and 22*b* with respect to the perpendicular direction (arrow E) to the rotation shaft of the unsealing member 20. The openings 35*a* may only be required to be located at the different positions in the rotational axis direction R of the unsealing member. Even when the openings 35*a* overlap with each other with respect to the rotational axis direction R as shown in (b) of FIG. 8 and do not overlap with each other completely with respect to the rotational axis direction R as shown in (d) of FIG. 8, the force can be transmitted as shown by the arrow P and there is the effect of the connecting portions 35*b*.

Thus, by the presence of the connecting portions 35*b* for bridging the first and second bonded portions 22*a* and 22*b* at the discharging portion 35, the developer accommodating container 26 accommodating the developer and the developer accommodating container 30 including the unsealing member 20 can transmit the unsealing force of the unseal member 20 until the second bonded portion 22*b* is unsealed, so that the unsealing can be effected with reliability.

Further, a relationship between the openings 35*a* and the portion-to-be-engaged 19*b* of the sealing member will be described (FIG. 5). The portion-to-be-engaged 19*b* is provided in an end side of the sealing member 19 with respect to the direction substantially perpendicular to the direction in which the plurality of openings are arranged.

A relationship between the openings 35*a* and the unsealing member 20 will be described (FIG. 5). The unsealing member 20 is provided in an end side of the sealing member 19 with respect to the direction substantially perpendicular to the direction in which the plurality of openings are arranged.

Also in such a constitution, it is possible to obtain the effect of transmitting the unsealing force of the unsealing member 20 by the connecting portions 35*b* until the second bonded portion 22*b* is unsealed.

(Example in which Connecting Portions are Separate Members)

Figure 19:
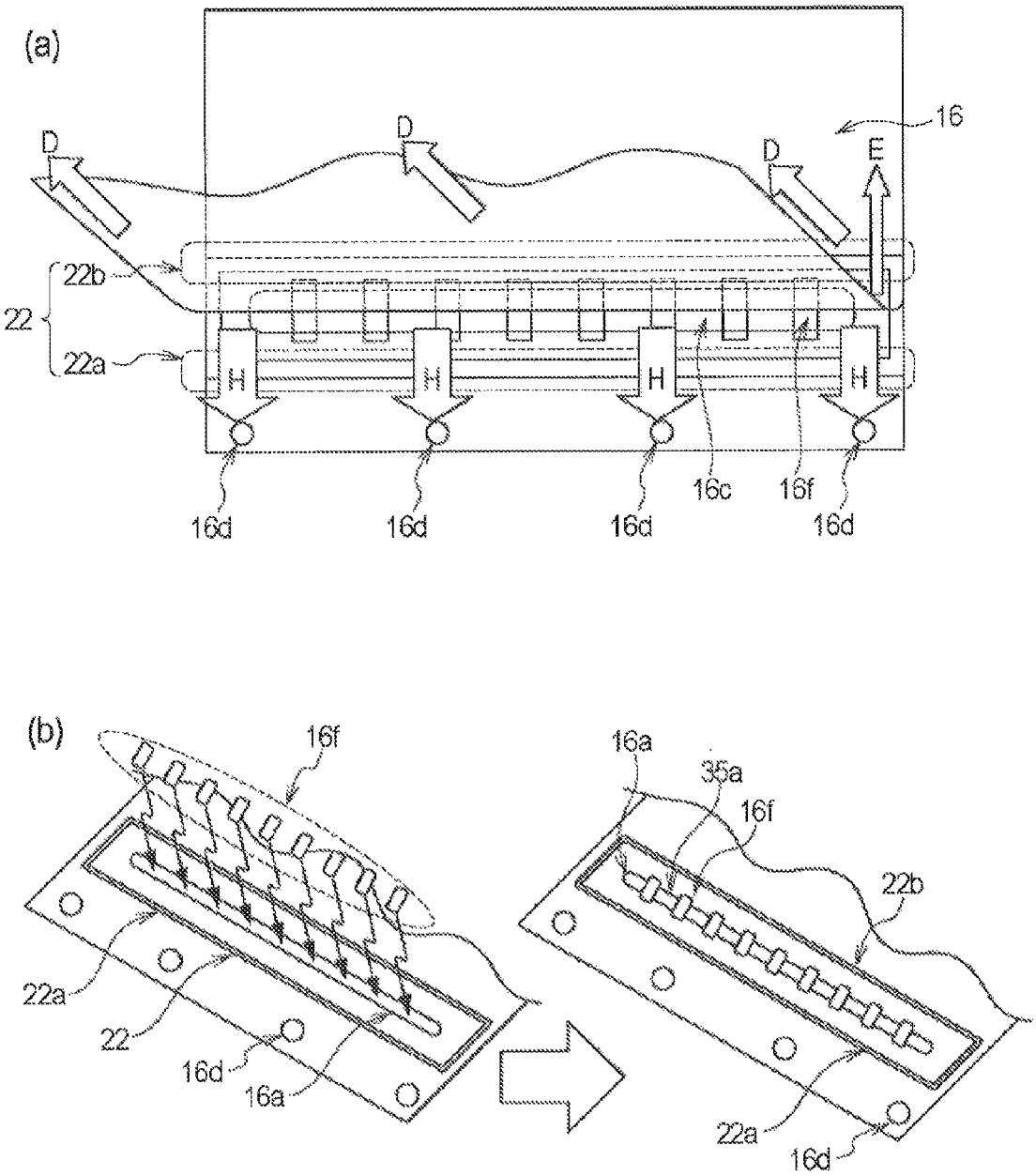
FIG. 19 includes illustrates of a constitution in which a connecting portion is a separate member.

Further, as shown in FIG. 19, the connecting portions 35*b* defining the openings 35*a* may also be separate members (connecting members 16*f*). In this case, a constitution in which a single long opening 16*a* in the direction F perpendicular to the unsealing direction E is provided and the connecting members 16*f* as the separate member connecting both sides of the opening 16*a* along the unsealing direction E ere provided on the single long opening 16*a* is employed. At this time, the connecting members 16*f* are bonded in each of the first bonded portion 22*a* side and the second bonded portion 22*b* side of the long single opening 16*a* by adhesive bonding, welding or the like.

Incidentally, also in the case where the developer bag 16 is provided with the connecting members 16*f*, the sealing member 19 is folded back between the bonded portion 22 and the portion-to-be-engaged 19*b* as described above and is wound around the unsealing member 20, so that the developer bag 16 is unsealable. By employing such a constitution, the connecting portions 35*b* defining the openings in the case where the plurality of openings 35*a* are provided, and the connecting members 16*f* perform the same function. That is, the long single opening 16*a* is the same as the case where there are the plurality of openings 35*a* by providing the connecting members 16*f*.

Therefore, when the sealing member 19 is peeled at the second bonded portion 22*b* after the unsealing at the first bonded portion 22*a* is ended, the force (arrow D) during the unsealing at the second bonded portion 22*b* by the unsealing member 20 can be received by the first fixing portion 16*d* via the connecting members 16*f* with respect to the arrow H direction. Therefore, the force for peeling the sealing member 19 from the developer bag 16 can be transmitted. That is, the forces are applied to the second bonded portion 22*b* in the arrow D direction and the arrow H direction, so that the unsealing is enabled also the second bonded portion 22*b*.

In this way, the long single opening 16*a* forms the plurality of openings 35*a* by the connecting members 16*f*, so that it also becomes possible to strengthen only the connecting members 16*f*.

(Problem of Unsealing Property in Case where Connection Portion is not Provided)

Figure 20:
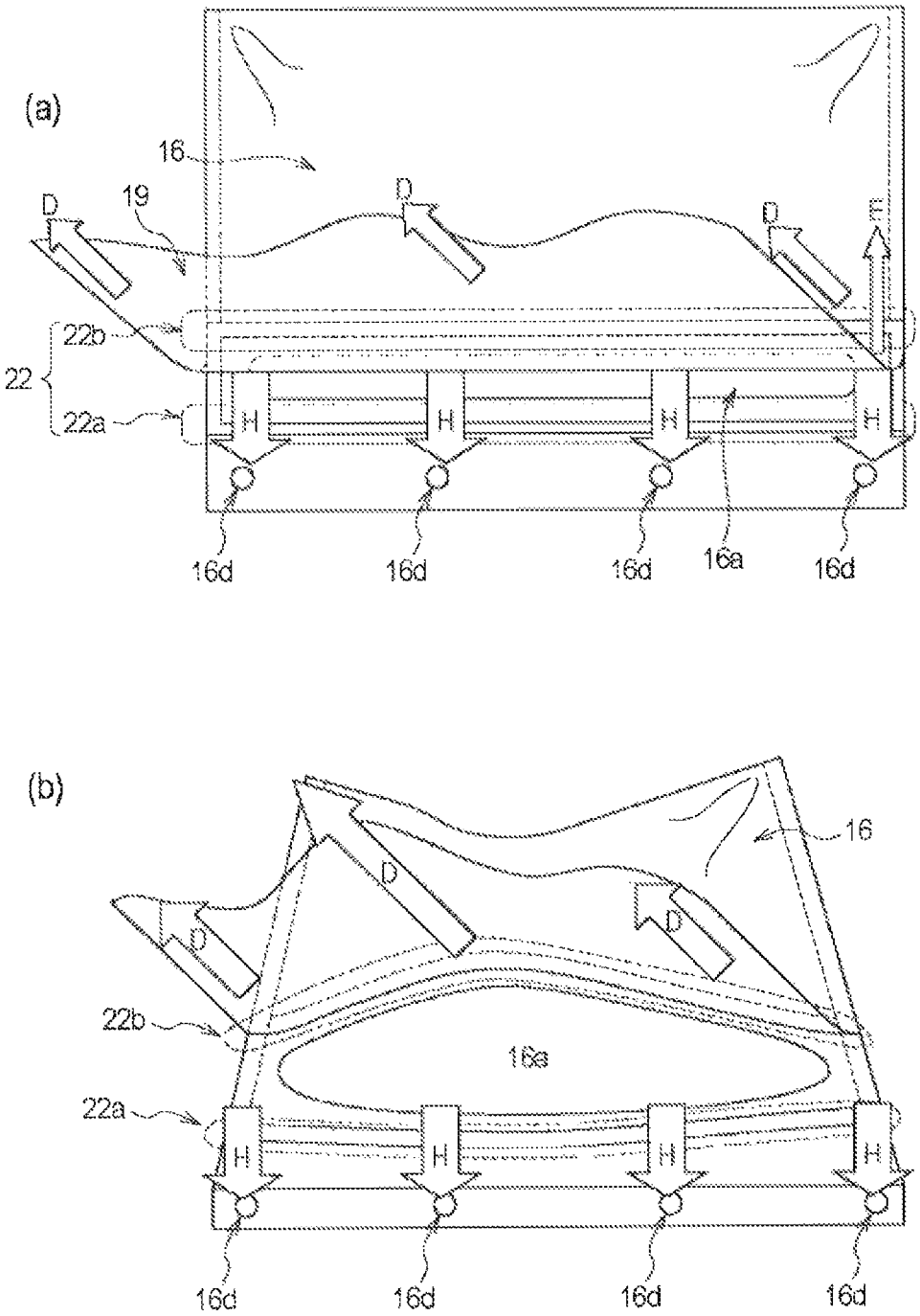
FIG. 20 includes illustrations when the opening provided with no connecting portion is unsealed.
Figure 21:
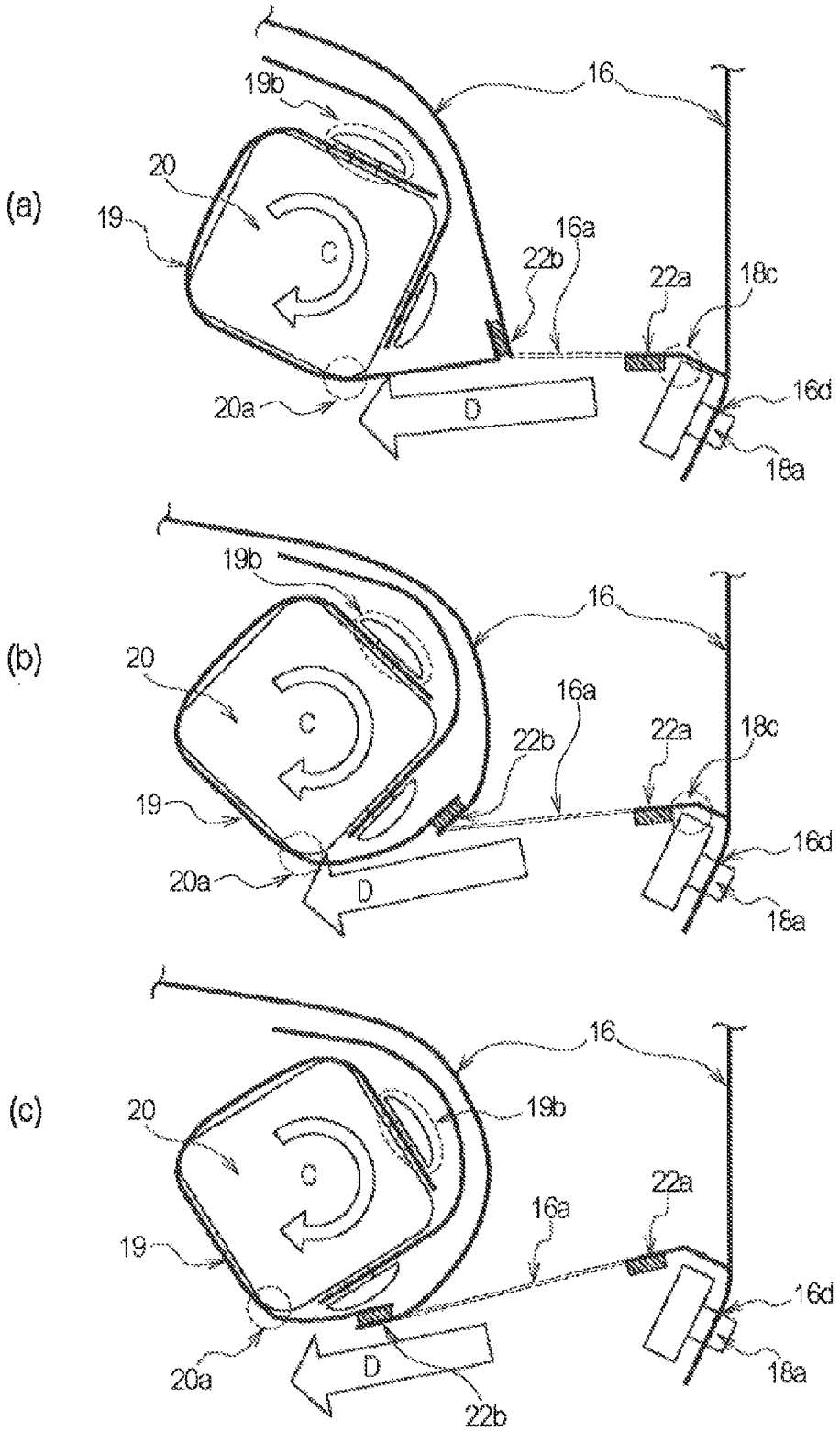
FIG. 21 includes illustrations when the opening provided with no connecting portion is unsealed.
Figure 22:
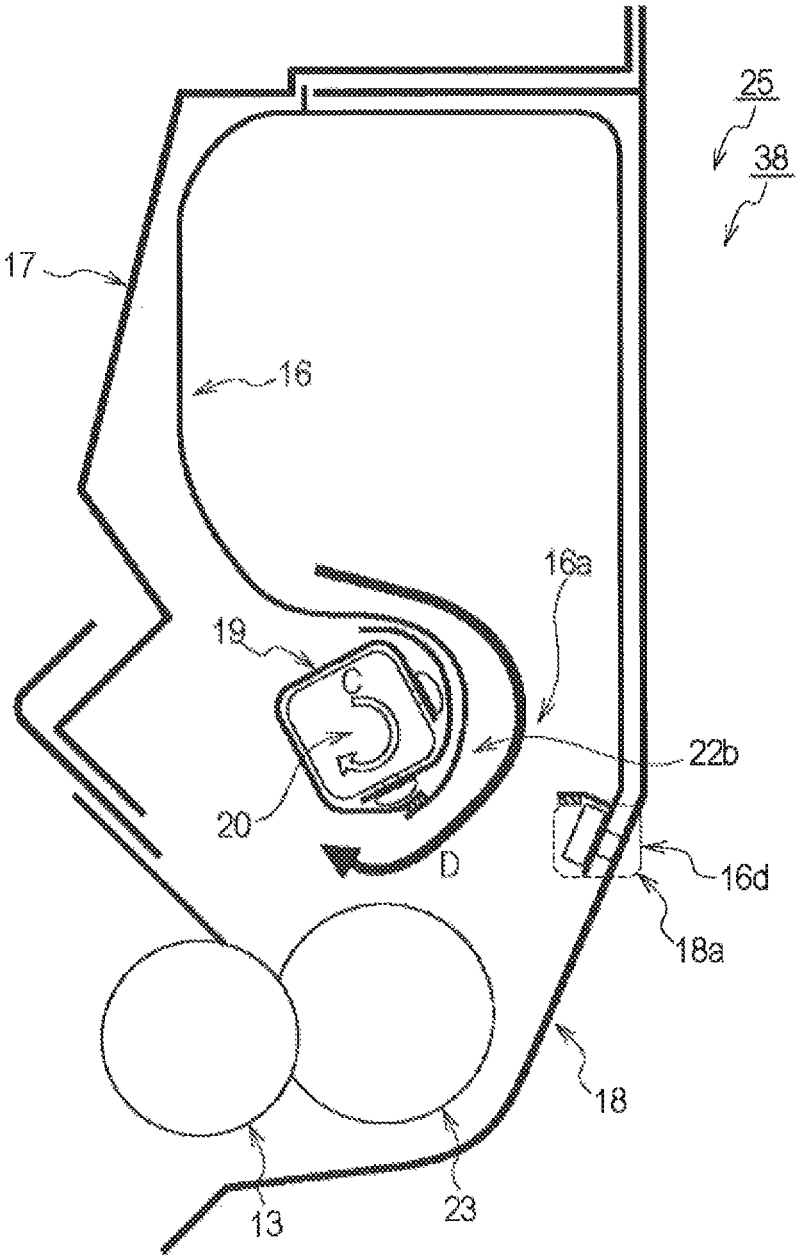
FIG. 22 is an illustration when the opening provided with no connecting portion is unsealed.

Here, the case where the discharging portion 35 is not provided with the connecting portions 35*b* will be described. This is, as shown in FIGS. 20 and 21, the case where there are no connecting portions 35*b* and it becomes difficult to affect the unsealing. FIG. 20 is an example in which there are no connecting portions 35*b* and there is a single opening 16*a*, in which (a) of FIG. 20 is a view showing a state before the peeling at the second bonded portion 22*b*, and (b) of FIG. 20 and FIG. 22 are views showing a state when the sealing member 19 is peered at the second bonded portion. Further, FIG. 21 includes sectional views at the periphery of the opening 35*a* in the case where there are no connecting portions 35*b* and thus it becomes difficult to effect the unsealing.

In this case, a state in which the unsealing advances to the second bonded portion 22*b* is (a) of FIG. 21, and from this state, the sealing member 12 is pulled and moved in the arrow D direction by further rotation of the unsealing member 20. Then, since there are no connecting portions 35*b*, the force from the first fixing portion 16*d* cannot be transmitted to the second bonded portion 22*b* side at the central portion of the opening 16*a* . For that reason, as shown in (b) of FIG. 21 and (b) of FIG. 20, a binding force from the fixing portion 18*a* of the frame to the second bonded portion 22*b* is eliminated, so that the opening 16*a* gradually opens largely in the arrow D direction. Further, the second bonded portion 22*b* is pulled by the sealing member 19, so that the opening 16*a* is deformed as shown in (e) of FIG. 21. In this case, a force acting on the second bonded portion 22*b* fails to provide the inclination peeling positional relationship as (see FIG. 12) and causes the shearing peeling (approximately 0-degree peeling) by the deformation of the opening 35*a* as shown in (c) of FIG. 21, so that a large force is required for the peeling. Moreover, the supporting force of the first fixing force 16*d* cannot be transmitted to the second bonded portion 22*b* and therefore the second bonded portion 22*b* is pulled by the unsealing member 20 without causing the peeling of the sealing member 19 therefrom. For that reason, the opening 16*a* in the neighborhood of a longitudinal central portion of the second bonded portion 22*b* further opens largely, so that the second bonded portion 22*b* is wound about the unsealing member 20. Also in such a case, as shown in FIG. 14, by disposing the second bonded portion 22*b* so as to be spaced from the openings 35*a*, it becomes possible to suppress the deformation of the openings 35*a*. By this, the unsealing stability is improved.

Incidentally, if a member for accommodating the developer is a rigid member such as a structure, there is no such a deformation, so that the sealing can be made as in the conventional example. However, in the case of a constitution in which the developer is accommodated in a deformable soft bag-like member and an opening which is deformed during unsealing is unsealed, as described above, it is desirable that the plurality of openings 36*a* are provided, and moreover the connecting portions 35*b* are provided between adjacent openings.

<Constitution of Unsealing Developer Bag during Unsealing>

Figure 23:
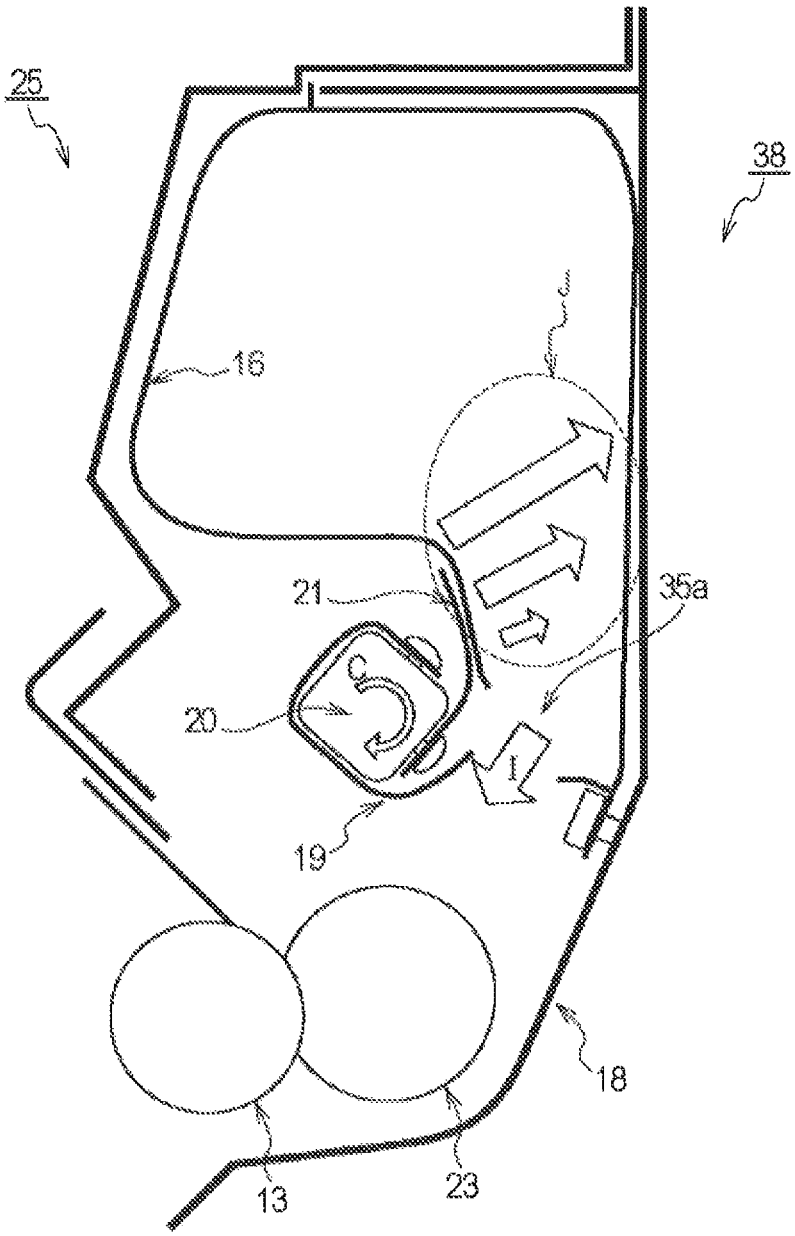
FIG. 23 is a view for illustrating unsealing of a developer bag by an urging member when the unsealing member is rotated.

As shown in FIG. 23, on the unsealing member 20, the urging member 21 is mounted. In this embodiment, the urging member, a flexible sheet formed of PET, PPS (polyphenylene sulfide) or polycarbonate or the like, in a thickness of about 0.05-0.1 mm, and an end thereof projects to the outside of a circumscribed circle of the unsealing member 21.

This urging member 21 has a function of acting so as to urge the developer bag 16 from the outside of the developer bag 16 when the unsealing member 20 is rotated, thus accelerating the discharge of the developer.

<Other Examples of Shape of Opening>

Figure 24:
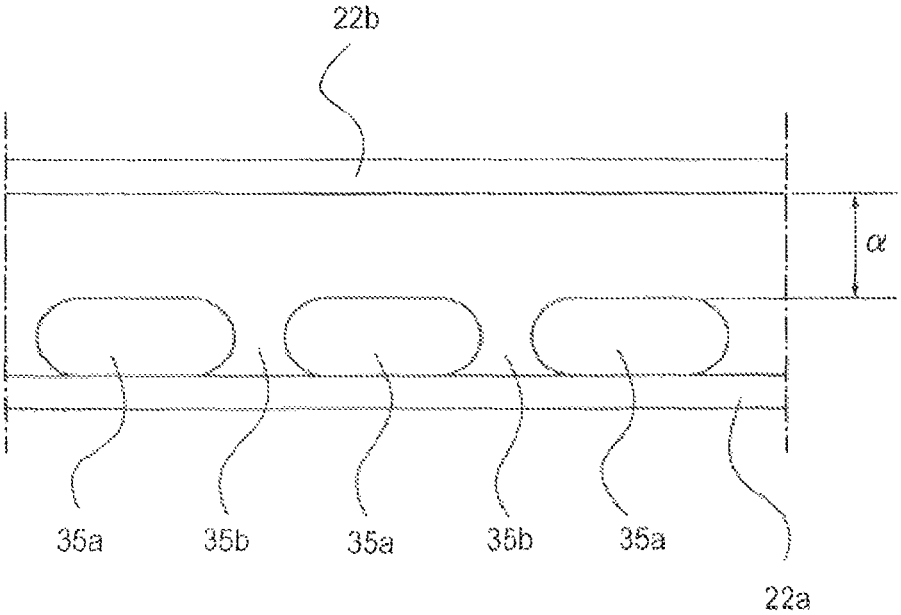
FIG. 24 is as illustration when the openings are made elongated circular holes.
Figure 25:
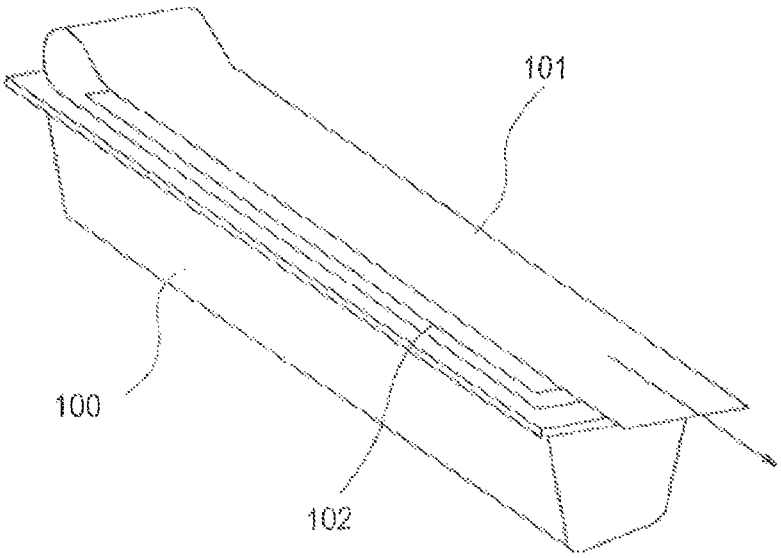
Fig. 25 PRIOR ART
FIG. 25 is a view for illustrating a conventional example.

In the above-described embodiment, an example in which the openings 35*a* are shaped in circles was shown. However, the shape of the openings 35*a* may also be, in addition to the circular shape, an elongated circular shape as shown in e.g., FIG. 24. As in the elongated circular shape, a rectangular shape or the like, when a shape including a rectilinear portion with respect to the direction crossing the unsealing direction of the sealing member 19 is provided, it is possible to ensure the distance $\alpha$ from the peeling direction downstream-side edge portion of the openings to the second bonded portion 22*b*.

<Other Examples of Flexible Container>

Further, in the above-described embodiment, an example using the developer bag 16 as the flexible container for accommodating the developer is shown, but in place of the bag, sheet-like materials shaped by vacuum molding, air-pressure molding and press molding may also be used. By the vacuum molding or the like, the flexible container can be molded into a shape along the shape of the frame, and a molded product itself will maintain its shape, and therefore there is an advantage that the flexible container is supported as a whole by the frame and thus is not readily moved toward the developer supplying roller 23 and the developing roller 13.

[Industrial Applicability]

According to the present invention, there is provided a developer accommodating container capable of suppressing deformation of the openings by weakening a force exerted on the openings and capable of effecting stable unsealing when the openings of the flexible container are unsealed by moving the sealing member.

The invention claimed is:

1. A developer accommodating container for accommodating developer, said developer accommodating container comprising:

a flexible container provided with an opening for permitting discharge of the developer; and a sealing member which includes a bonded portion bonded to an outer surface of said flexible container so as to seal the opening and which is capable of exposing the opening by peeling said bonded portion from said flexible container, wherein said sealing member includes a first bonded portion in an upstream side of the opening and a second bonded portion in a downstream side of the opening with respect to a sealing member unsealing direction, said second bonded portion being provided in a non-contact position with the opening, and wherein, where said sealing member is unsealed, a shape of the opening is changed.

2. A developer accommodating container according to claim 1, wherein said first bonded portion is provided in a contact position with the opening.

3. A developer accommodating container according to claim 1, wherein in said developer accommodating container, the opening includes a rectilinear line portion in a direction crossing the sealing member unsealing direction.

4. A developer accommodating container according to claim 1, wherein the opening is provided at a plurality of positions of said flexible container.

5. A process cartridge detachably mountable to an image forming apparatus main assembly, which is a process cartridge in which a developer accommodating container according to claim 1 and an electrophotographic photosensitive member are integral with each other.

6. An electrophotographic image forming apparatus comprising A process cartridge according to claim 5.

7. A developer accommodating container according to claim 1, wherein a distance from the opening to said second bonded portion is longer than a distance from the opening to said first bonded portion.

8. A developer accommodating container according to claim 1, wherein a length of the opening with respect to the sealing member unsealing direction is longer than a length of the opening with respect to a direction perpendicular to the sealing member unsealing direction.

9. A developing device comprising:

a developer accommodating container according to claim 1, and a developing roller.

10. A developing device comprising:

a developer accommodating container according to claim 1, and a frame in which said flexible container is accommodated.

11. A developer accommodating container according to claim 1, wherein the sealing member unsealing direction crosses a longitudinal direction of said flexible container.

12. A developer accommodating container according to claim 11, wherein the sealing member unsealing direction is perpendicular to the longitudinal direction of said flexible container.

13. A developer accommodating container according to claim 1, further comprising an unsealing member.

14. A developer accommodating container according to claim 1, wherein said flexible container is provided with a plurality of openings.

15. A developer accommodating container according to claim 14, wherein the openings are located between said first and second bonded portions.

16. A developer accommodating container for accommodating developer, said developer accommodating container comprising:

a flexible container provided with a plurality of openings for permitting discharge of the developer; and a sealing member which includes a bonded portion bonded to an outer surface of said flexible container so as to seal and surround the plurality of openings and which is capable of exposing the plurality of openings by peeling said bonded portion from said flexible container, wherein said sealing member includes a first bonded portion in an upstream side of the plurality of openings and a second bonded portion in a downstream side of the plurality of openings with respect to a sealing member unsealing direction, said second bonded portion being provided in a non-contact position with the plurality of openings, and wherein the plurality of openings are located between said first and second bonded portions.

17. A developer accommodating container according to claim 16, wherein said first bonded portion is provided in a contact position with the plurality of openings.

18. A developer accommodating container according to claim 16, wherein in said developer accommodating container, the plurality of openings include a rectilinear line portion in a direction crossing the sealing member unsealing direction.

19. A developer accommodating container according to claim 16, wherein, when said sealing member is unsealed, a shape of the opening is changed.

20. A developer accommodating container according to claim 16, wherein a distance from the opening to said second bonded portion is longer than a distance from the opening to said first bonded portion.

21. A developer accommodating container according to claim 16, wherein a length of the opening with respect to the sealing member unsealing direction is longer than a length of the opening with respect to a direction perpendicular to the sealing member unsealing direction.

22. A developing device comprising:

a developer accommodating container according to claim 16, and a developing roller.

23. A developing device comprising:

a developer accommodating container according to claim 16, and a frame in which said flexible container is accommodated.

24. A developer accommodating container according to claim 16, wherein the sealing member unsealing direction crosses a longitudinal direction of said flexible container.

25. A developer accommodating container according to claim 24, wherein the sealing member unsealing direction is perpendicular to the longitudinal direction of said flexible container.

26. A developer accommodating container according to claim 16, further comprising an unsealing member.

27. A developer accommodating container for accommodating developer, said developer accommodating container comprising:

a flexible container provided with a through hole for permitting discharge of the developer; and a sealing member which includes a bonded portion bonded to said flexible container so as to seal the through hole and which is capable of exposing the through hole by peeling said bonded portion from said flexible container, wherein said sealing member includes a first bonded portion in an upstream side of the through hole and a second bonded portion in a downstream side of the through hole with respect to a sealing member unsealing direction, said second bonded portion being provided in a non-contact position with the through hole, and wherein, when said sealing member is unsealed, a shape of the through hole is changed.

28. A developer accommodating container according to claim 27, wherein said first bonded portion is provided in a contact position with the through hole.

29. A developer accommodating container according to claim 27, wherein in said developer accommodating container, the through hole includes a rectilinear line portion in a direction crossing the sealing member unsealing direction.

30. A developer accommodating container according to claim 27, wherein a distance from the through hole to said second bonded portion is longer than a distance from the through hole to said first bonded portion.

31. A developer accommodating container according to claim 27, wherein a length of the through hole with respect to the sealing member unsealing direction is longer than a length of the through hole with respect to a direction perpendicular to the sealing member unsealing direction.

32. A developing device comprising:

a developer accommodating container according to claim 27, and a developing roller.

33. A developing device comprising:

a developer accommodating container according to claim 27, and a frame in which said flexible container is accommodated.

34. A developer accommodating container according to claim 27, wherein the sealing member unsealing direction crosses a longitudinal direction of said flexible container.

35. A developer accommodating container according to claim 34, wherein the sealing member unsealing direction is perpendicular to the longitudinal direction of said flexible container.

36. A developer accommodating container according to claim 27, further comprising an unsealing member.

37. A developer accommodating container according to claim 27, wherein said flexible container is provided with a plurality of openings.

38. A developer accommodating container according to claim 37, wherein the openings are located between said first and second bonded portions.

* * * * *